US012662826B2

(12) United States Patent
Davis

(10) Patent No.: US 12,662,826 B2
(45) Date of Patent: Jun. 23, 2026

(54) CONCRETE SCREED DEVICE WITH OSCILLATING SCREED BAR

(71) Applicant: BAD ASS TOOLS LLC, Somers, CT (US)

(72) Inventor: Charles H. Davis, Somers, CT (US)

(73) Assignee: BAD ASS TOOLS LLC, Somers, CT (US)

( * ) Notice: Subject to any disclaimer, the term of this patent is extended or adjusted under 35 U.S.C. 154(b) by 631 days.

(21) Appl. No.: 18/316,009

(22) Filed: May 11, 2023

(65) Prior Publication Data

US 2023/0366218 A1 Nov. 16, 2023

Related U.S. Application Data

(63) Continuation-in-part of application No. 17/744,020, filed on May 13, 2022, now Pat. No. 12,460,431.

(51) Int. Cl.
*E04F 21/24* (2006.01)
*E01C 19/35* (2006.01)

(52) U.S. Cl.
CPC ..... *E04F 21/242* (2013.01); *E01C 19/35* (2013.01)

(58) Field of Classification Search
CPC ..... E04F 21/242; E01C 19/35
USPC ..... 404/114, 118–120
See application file for complete search history.

(56) References Cited

U.S. PATENT DOCUMENTS 2,372,163 A * 3/1945 Whiteman ..... E04G 21/10 404/119
4,861,188 A 8/1989 Rouillard
5,375,942 A 12/1994 Lindley et al.
5,857,803 A 1/1999 Davis et al.
6,223,495 B1 * 5/2001 Shaw ..... E04F 21/04 52/DIG. 1
6,293,780 B1 9/2001 Rijkers
6,296,467 B1 10/2001 Rouillard
6,695,531 B1 2/2004 Prescott
6,976,805 B2 12/2005 Quenzi et al.
7,052,204 B2 5/2006 Lutz
(Continued)

FOREIGN PATENT DOCUMENTS

WO WO-2006039397 A1 * 4/2006 ..... E04F 21/241

OTHER PUBLICATIONS lowes.com, "Tomahwak Power Manual Concrete Screed," URL: https://www.lowes.com/pd/Tomahawk-Power-37-7cc-Gas-Concrete-Power-Screed-Cement-Finishing-Vibrating-Motor/5000235501?cm_mmc=shp-_-c-_prd-Discloses; Retrieved: May 16, 2022; 4 pages.
(Continued)

*Primary Examiner* — Raymond W Addie
(74) *Attorney, Agent, or Firm* — CANTOR COLBURN LLP

(57) ABSTRACT

A concrete screed device, having: a base bar extending between first and second ends and having a bottom member and an upright member; a handle structure connected to the base bar, between the first and second ends, and extending away from the base bar to a grip portion; a screed bar disposed against the upright member of the base bar; guide members connected to the screed bar and extending through the upright member of the base bar; a battery powered motor supported along the base bar and operationally connected to one of the guide members to oscillate the screed bar against the base bar; and a wheel supported under the bottom member of the base bar near the first end of the base bar.

20 Claims, 23 Drawing Sheets

(56) References Cited

U.S. PATENT DOCUMENTS

| | | | | |
|---|---|---|---|---|
| 7,097,384 | B2 | 8/2006 | Lindley | |
| 7,153,058 | B2 | 12/2006 | Lindley | |
| 7,156,577 | B1 | 1/2007 | Rozinski | |
| 7,175,365 | B1 | 2/2007 | Breeding | |
| 7,201,537 | B2 | 4/2007 | Sina | |
| 7,320,558 | B2 | 1/2008 | Quenzi et al. | |
| 7,491,011 | B2 | 2/2009 | Quenzi et al. | |
| 7,651,296 | B2 | 1/2010 | Lindley | |
| 8,182,173 | B2 | 5/2012 | Lickel | |
| 8,439,600 | B2 | 5/2013 | Brening | |
| 8,608,402 | B2 | 12/2013 | Argento et al. | |
| 9,091,028 | B1 | 7/2015 | McCary, Sr. et al. | |
| 10,326,331 | B2 | 6/2019 | Mikowychok | |
| 10,968,574 | B2 | 4/2021 | Mikowychok | |
| 2009/0092444 | A1 | 4/2009 | Schoen | |
| 2020/0087871 | A1 | 3/2020 | Terstriep | |
| 2022/0325535 | A1* | 10/2022 | Richardet | E04F 21/241 |
| 2023/0128185 | A1 | 4/2023 | Mcintosh | |

OTHER PUBLICATIONS northerntool.com, "Wyco Tool Concrete Screed," URL: https://www.northerntool.com/shop/tools/product_200162224_200162224?cm_mmc=Google-Discloses; Retrieved: May 16, 2022; 1 page.

* cited by examiner

Direction of User Travel TR

CONCRETE SCREED DEVICE WITH OSCILLATING SCREED BAR

CROSS REFERENCE

This application is a Continuation-In-Part of U.S. Non-Provisional application Ser. No. 17/744,020 filed on May 13, 2022, the disclosure of which is incorporated herein by reference in its entirety.

BACKGROUND

The embodiments are directed to a concrete screed device and more specifically to a concrete screed device with an oscillating screed bar.

Concrete is made up of four elements; stone, cement, sand, and water. Stone is the strength, cement is the glue, sand if the filler, and water is the activator. Concrete is delivered to the jobsite via a concrete truck. Slump of concrete defines the water content or wetness of the material. Slump is described by a number ranging from 1" to 10". 1" to 3" slumps are very stiff or dry concrete. 4" to 5" slumps are considered to be decent for flat work. 6" to 10" slumps are considered to be too wet. Slump numbers may vary depending on the task on that particular project or day. Factors such as how close a truck can get to the work area, weather conditions on that day, and the actual process that contractor is using that day are all part of the thought process going on to determine the slump requested on that day.

Once a proper slump is established and the driver adds and mixes in the water requested, concrete is dumped onto the work area of the day. Flat work jobs require different ways and/or methods of placement of concrete, but generally the truck will disperse the material by moving the concrete chute that is attached to the truck around the site as per contractor's instructions. As the concrete is flowing to the ground, the site laborers rake or move the concrete around to a more accurate, predetermined grade, generally by either grade stakes, or by an onsite laser.

Once concrete is dumped, it generally needs to be finished, though the leveling technique may depend on the type of slab. Wet slabs are generally any slab, usually flat and level, sometimes sloped, such as a large garage floor. Basement floors are an example in which rakes are used to obtain a desired grade, then the floor is finished.

Sidewalks also require finishing of wet concrete. Round slabs or round and sloped slabs are poured similarly, but create other issues that complicate the finishing method. Sloped slabs similarly are poured rail to rail, but create finishing issues that need to be addressed in different ways. Stamped concrete is relatively popular, as are other decorative concrete methods, but they also must be addressed differently when finishing.

A wet concrete floor may be finished via a screed. Screed work may often require raking concrete at the unleveled side of the bar to prevent the concrete from flowing back under the base bar. Screed work may be laborious and if executed poorly may result in a surface finish that is uneven or weak.

BRIEF SUMMARY

Disclosed is a concrete screed device, including: a base bar extending between first and second ends and having a bottom member and an upright member; a handle structure connected to the base bar, between the first and second ends, and extending away from the base bar to a grip portion; a screed bar disposed against the upright member of the base bar; guide members connected to the screed bar and extending through the upright member of the base bar; a battery powered motor supported along the base bar and operationally connected to one of the guide members to oscillate the screed bar against the base bar; and a wheel supported under the bottom member of the base bar near the first end of the base bar.

In addition to one or more aspects of the screed, or as an alternate, the handle structure is removably connected to the device and configured for being pivoted against the base bar.

In addition to one or more aspects of the screed, or as an alternate, the handle structure is at least partially angled toward the wheel.

In addition to one or more aspects of the screed, or as an alternate, the motor is supported within a motor housing that is removably connected to one of the guide members.

In addition to one or more aspects of the screed, or as an alternate, the guide members include at least one guide member located midway between the first and second ends of the base bar, and the motor is removably connected to the at least one guide member.

In addition to one or more aspects of the screed, or as an alternate, a motor control is secured to the grip portion of the handle structure.

In addition to one or more aspects of the screed, or as an alternate, a first portion of a motor wire is connected to the motor control, a second portion of the motor wire is connected to the motor, and the first and second portions of the motor wires are connected to each other via a quick-release connector.

In addition to one or more aspects of the screed, or as an alternate, a battery is removably connected to the motor.

In addition to one or more aspects of the screed, or as an alternate, the base bar defines a base bar length; the screed bar defines a screed bar length that is less than the base bar length; and the screed bar is configured such that it remains between the first and second ends of the base bar throughout the oscillatory range of movement.

In addition to one or more aspects of the screed, or as an alternate, the screed includes a first wear strip disposed between the screed bar and the base bar.

In addition to one or more aspects of the screed, or as an alternate, the upright member of the base bar includes a top channel and a bottom channel that are spaced apart from each other, wherein the first wear strip is disposed in the top channel and a second wear strip is disposed in the bottom channel.

In addition to one or more aspects of the screed, or as an alternate, the top channel and the bottom channel have a trapezoidal shape.

In addition to one or more aspects of the screed, or as an alternate, the screed bar defines a screed bar height; the base bar defines a base bar height that is the same as the screed bar height; and the front surface of the screed bar, that faces away from the upright member of the base bar, is concave to define a shovel or plow.

Disclose is another concrete screed device, including: a base bar extending between first and second ends and having a bottom member and an upright member; a screed bar disposed against the upright member of the base bar; guide members connected to the screed bar and extending through the upright member of the base bar, including at least a guide member located near the first end of the base bar; and a battery powered hand-grip connected to the bottom member at the first end of the base bar, the hand-grip including an oscillating motor that is operationally connected to the guide member located near the first end of the base bar, wherein the oscillating motor oscillates the screed bar against the base bar.

In addition to one or more aspects of the another screed, or as an alternate, a battery is connected to the hand-grip via a quick release connection.

In addition to one or more aspects of the another screed, or as an alternate, the base bar defines a base bar length; the screed bar defines a screed bar length that is less than the base bar length; and the screed bar is configured such that it remains between the first and second ends of the base bar throughout the oscillatory range of movement.

In addition to one or more aspects of the another screed, or as an alternate, the another screed includes a first wear strip disposed between the screed bar and the base bar.

In addition to one or more aspects of the another screed, or as an alternate, the upright member of the base bar includes a top channel and a bottom channel that are spaced apart from each other, wherein the first wear strip is disposed in the top channel and a second wear strip is disposed in the bottom channel.

In addition to one or more aspects of the another screed, or as an alternate, the top channel and the bottom channel have a trapezoidal shape.

In addition to one or more aspects of the another screed, or as an alternate, the screed bar defines a screed bar height; the base bar defines a base bar height that is the same as the screed bar height; and the front surface of the screed bar, that faces away from the upright member of the base bar, is concave to define a shovel or plow.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Generally, and as provided in greater detail below, the disclosed embodiments provide a concrete screed device (or leveler) that removes excess concrete off of a top surface of wet concrete. The embodiments do not rely on the rakers. By utilizing the embodiments, flatter surfaces are obtainable. Stone aggregate remains close to the surface where it is most beneficial for surface strength. The embodiments avoid a thick layer of fines at the surface. The screed is capable of instant stopping and restarting on a wet slab and is light enough so it does not sink or damage a finished surface. A base bar is capable of gliding over wet concrete peaks or troughs and providing a level and finished surface. The screed is electrically controlled and optionally runs on a battery, such as a common 36 V tool battery (as a non-limiting example). Thus the screed produces minimal noise, no exhaust pollutants, does not require throttle cables, pull cords, oil, fuel or spark plugs of other screeds.

Figure 1A:
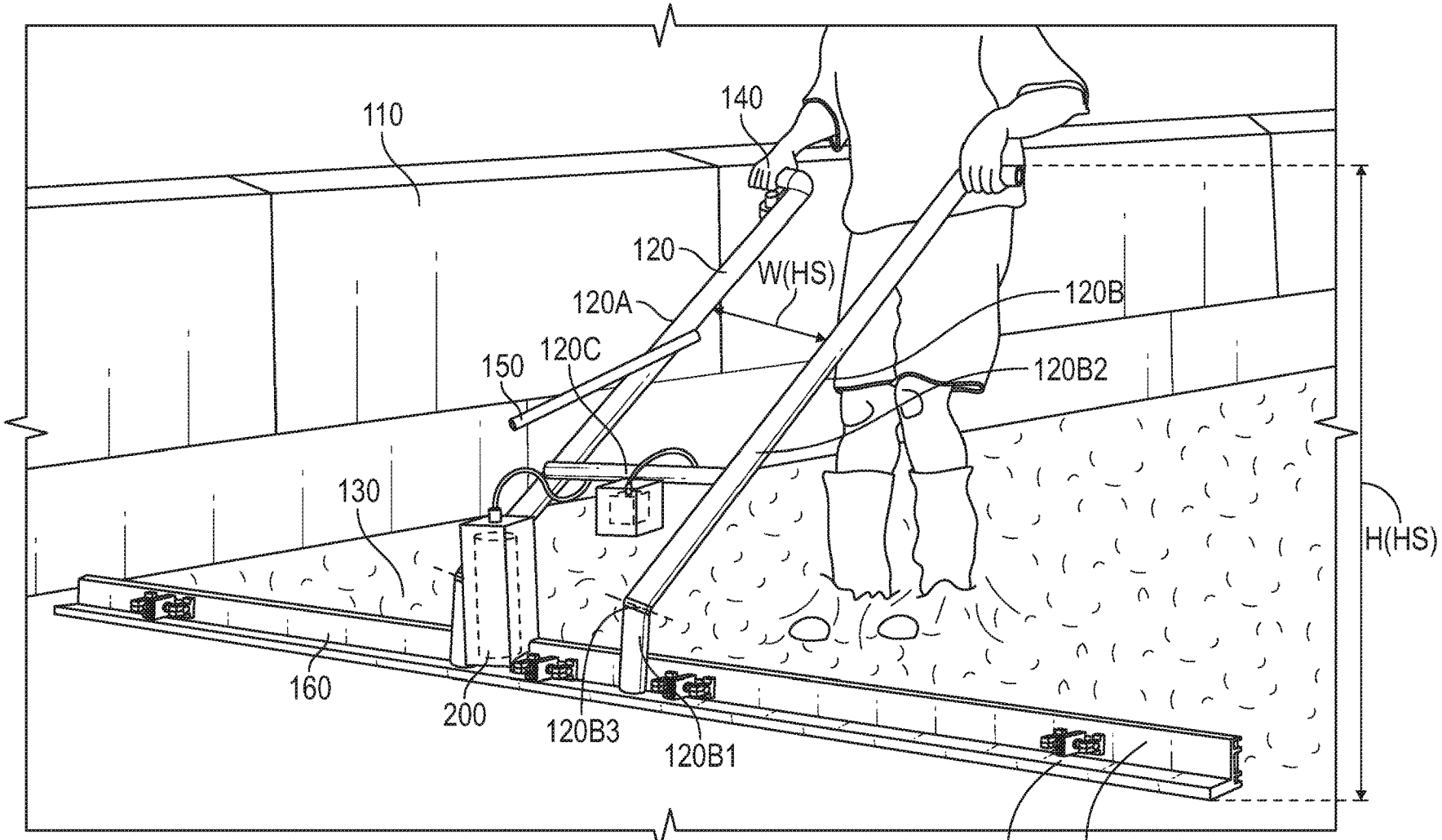
FIG. 1A shows a perspective view of a concrete screed device (or screed) according to an embodiment.

Turning to FIG. 1A, disclosed is a concrete screed device (or for simplicity, a screed) 110. The screed 110 may include a handle structure (or HS) 120. The handle structure 120 may be metal and for example aluminum. The handle structure 120 may define a lower end 130 and an upper end 140 spaced apart from each other, to define a screed handle structure height H(HS). The handle structure 120 may include a first elongate member (or first handle) 120A and a second elongate member (or second handle) 120B that are spaced apart from each other, to define a screed handle structure width W(HS). A crossmember 120C may be provided between the elongate members 120A, 120B for stability.

The screed handle structure height H (HS) may be such that a person moving the screed 110 can do so comfortably while standing upright. For example, the screed handle structure height H(HS) may be between four and six feet. When the screed 110 is utilized, the handle structure 120 may be angled to the vertical direction, which is typical for utilizing push/pull implements. A pivotal support leg or stand 150 may be provided to support the handle structure 120 when the screed 110 is not being utilized or to temporarily support the screed 110 while in use. The support leg 150 may be pivotally connected to, for example, the first elongate member 120A.

The lower end 130 of each member 120A, 120B may define a first segment, e.g., 120B1. Extending from the first segment 120B1 to the upper end 140 may be a second segment, e.g., 120B2. The segments 120B1, 120B2 may be joined at a pivot 120B3 (shown schematically) to enable height adjustment of the handle structure 120.

FIG. 1 also shows a base bar (or BB) 160 and motor 200, discussed in greater detail below. The base bar 160 has two purposes, to serve as a mounting structure for the components or appendages (motor, handles, slide bearing mounts, etc.) of the screed 110 and to enable the screed 110 to float on wet concrete. The base bar 160 has a bottom member 180A that moves over wet concrete and an upright member 180B. A screed bar 190 (or agitator bar, shown in FIG. 4) attached to the base bar 160 provides oscillating motion against the upright member 180B, screeding the wet concrete.

Figure 1C:
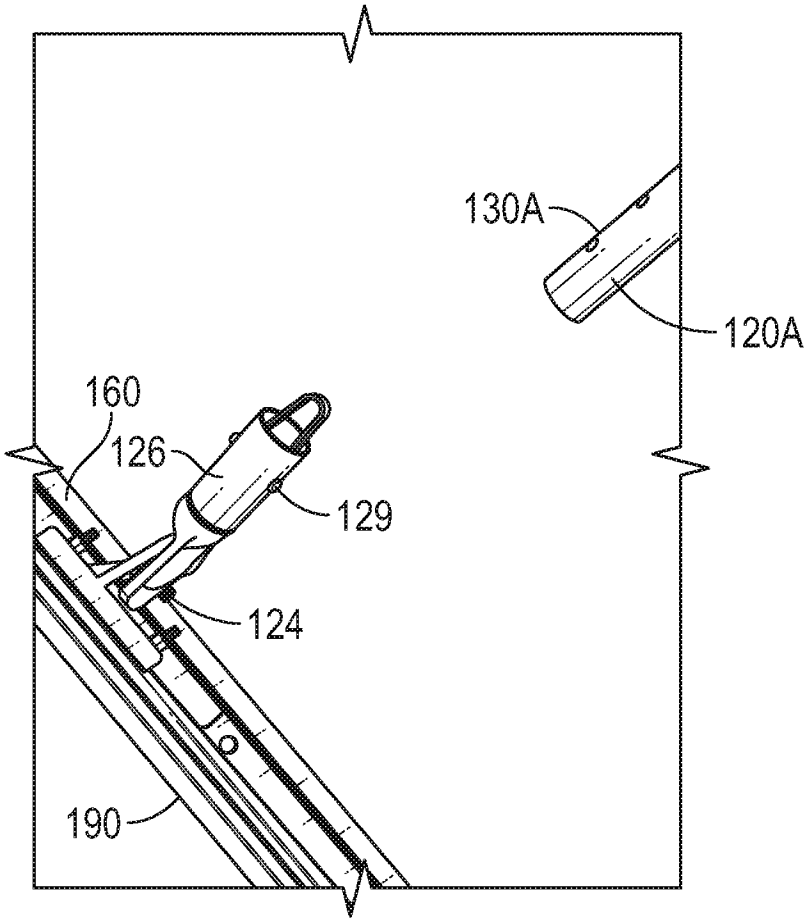
FIG. 1C shows additional aspects of the connection of pivot connectors with the handle structure of the screed.
Figure 1B:
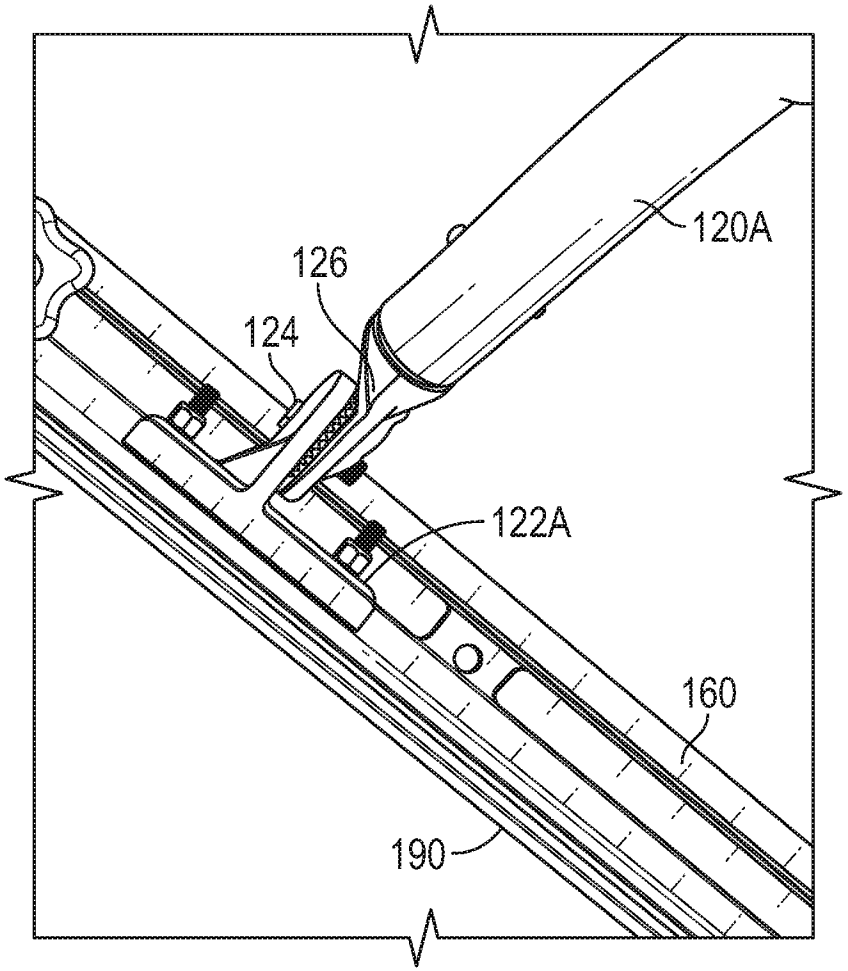
FIG. 1B shows pivot connectors for a handle structure of the screed.

Turning to FIGS. 1B and 1C, as indicated, the handle members 120A and 120B may each be pivotally connected to the base bar 160. For example, pivot brackets 122 such as first pivot bracket 122A may be connected to the upright member 180B of the base bar 160. The pivot brackets 122 may be spaced apart from each other by the corresponding distance between the lower ends 130 of the handle structures 120. Each pivot bracket 122 may have a pivot joint 124 and a stub shaft 126 connected to the pivot joint 124 that defines the orientation of the lower ends 130 of the handle structures 120. The angulation of the stub shafts 126 may be modified by loosening fasteners, such as butterfly nuts 128, and pivoting the stub shafts 126. The stub shafts 126 are hollow, and ends of the stub shafts 126 have spring loaded bosses 129 or posts protruding radially outwardly. The lower ends 130 of the handle structures define apertures 130A through which the bosses 129 extend to allow the handle members 120A and 120B to selectively lock against the stub shafts 126.

Figure 2:
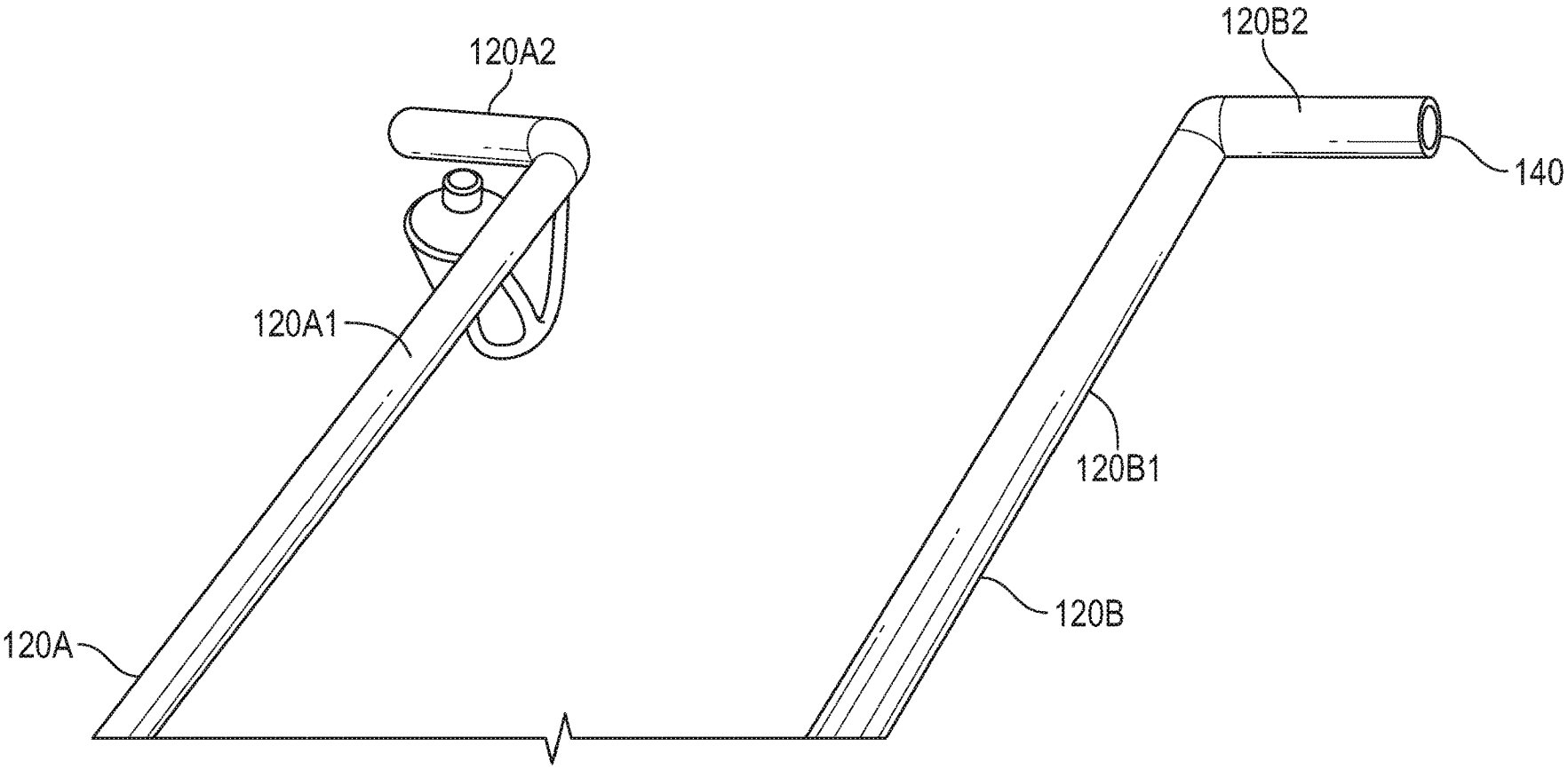
FIG. 2 shows a handle of a handle structure of the screed.

Turning to FIG. 2, the upper end 140 of the handle structure 120, and more specifically the upper ends 120A1, 120B1 of the first and second elongate members 120A, 120B, may define handle portions or grips 120A2, 120B2. The handle portions 120A2, 120B2 may extend away from each other or may form other configurations that are capable of being gripped. It is within the scope of the embodiments to have a tow attachment on the handle structure 120 rather than, or in addition to, handle portions 120A2, 120B2.

Figure 3:
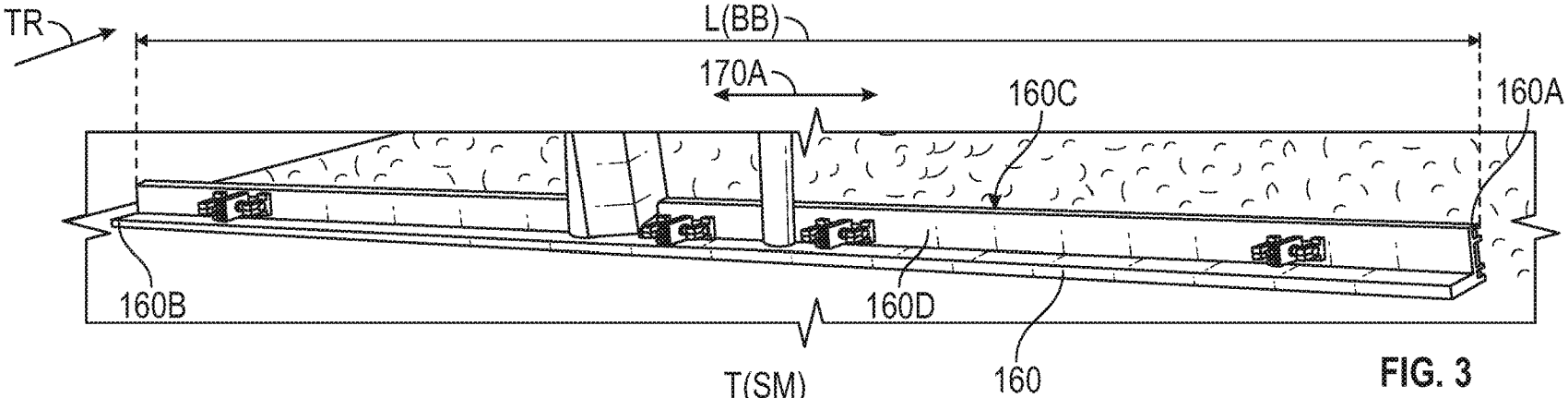
FIG. 3 shows back view of the screed, showing a base bar of the screed.

As shown in FIG. 3, the base bar 160 may have a first end 160A and a second end 160B spaced apart from each other in a first direction 170A (e.g., longitudinally), to define a base bar length L(BB). The base bar 160 may have a front side 160C and a back side 160D, defined along a direction of device travel TR, e.g., in operation. The back side 160D may be connected to the lower end 130 of the handle structure 120. The base bar 160 may be the same material as the handle structure 120.

Figure 4A:
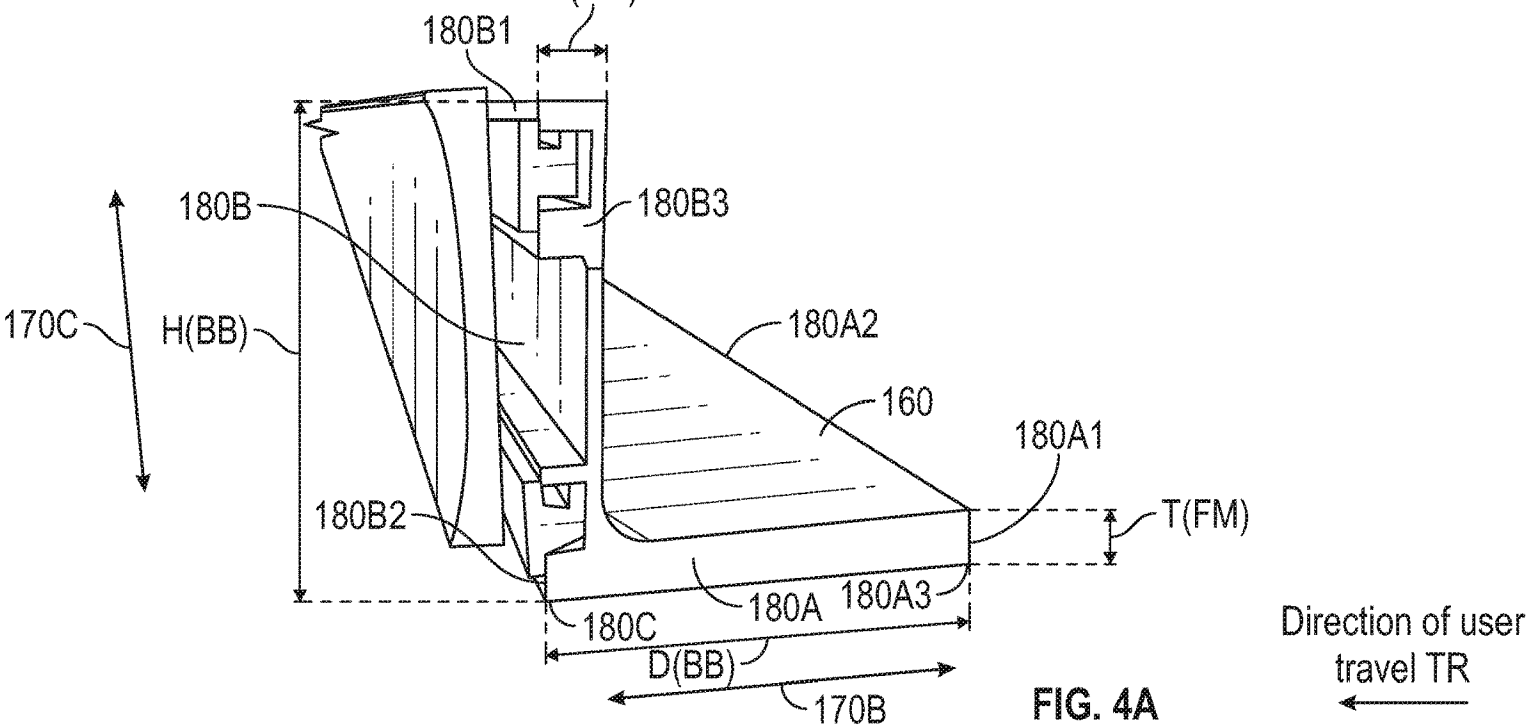
FIG. 4A shows a side view of the screed device, where tracks that receive wear strips have a rectangular cross section.
Figure 4B:
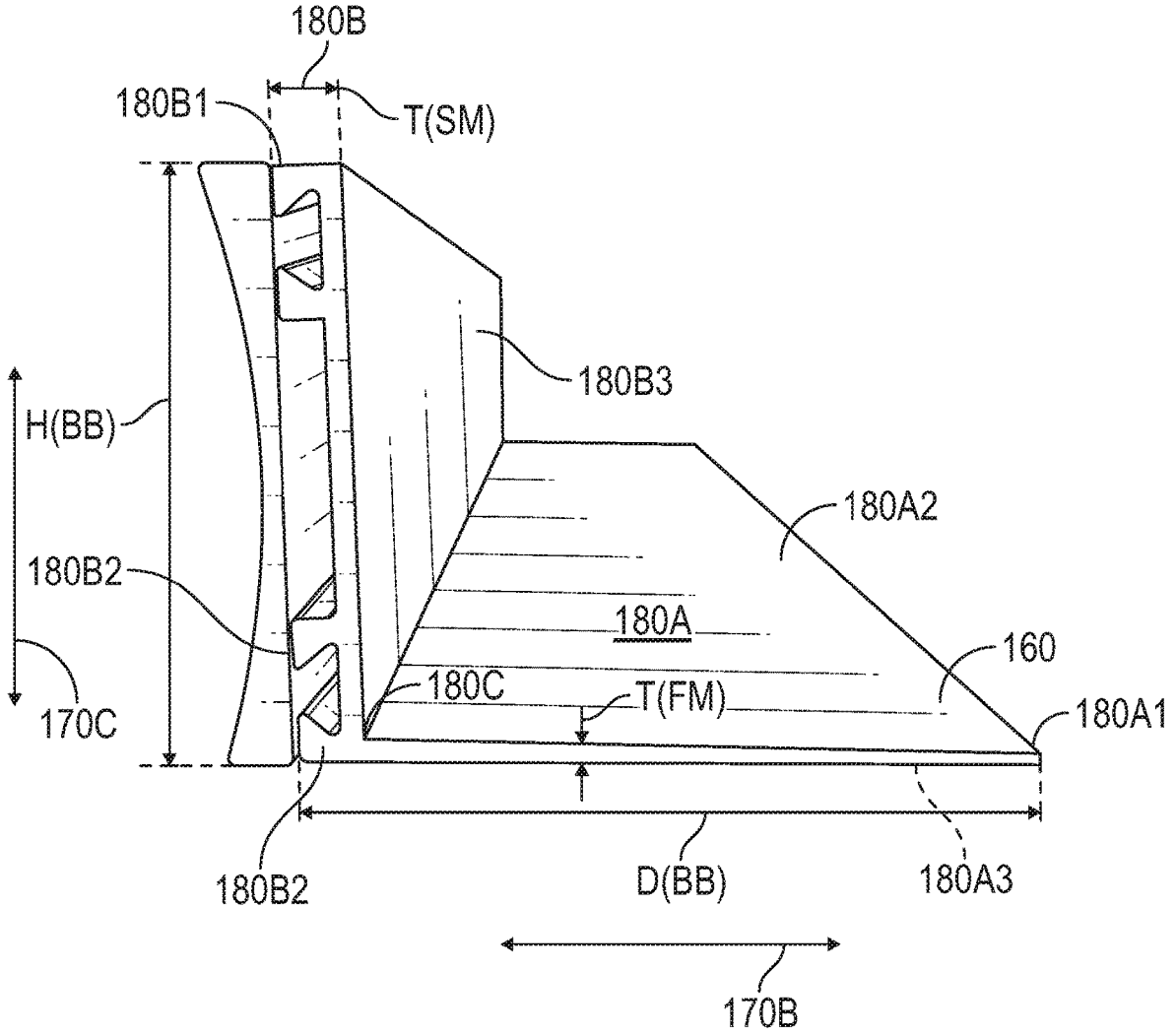
FIG. 4B shows another side view of the screed device, where tracks that receive wear strips have a trapezoidal cross section.

As shown in FIGS. 4A and 4B, the base bar 160 may be L-shaped in cross-section and include a first member (or FM) 180A (or bottom member) that, in operation of the screed 110, is horizontally oriented and moves over the wet cement, and a second member 180B (or upright member) that, in operation of the screed 110, is vertically oriented and extends away from the wet cement. The first and second members 180A, 180B are connected at a joint 180C. The first member 180A may extend from the joint 180C to a first outer end 180A1 along a second direction 170B (e.g., depthwise), toward the back of the screed, to define a base bar depth D(BB). The second member 180B may extend from the joint 180C to a second outer end 180B1 along a third direction 170C (e.g., heightwise), to define a base bar height H(BB).

As further shown in FIGS. 4A and 4B, the first member 180A may also include a top surface 180A2 and a bottom surface 180A3 spaced apart along the third direction 170C, to define a first member depth or thickness T(FM) (FIG. 4A). In operation, the bottom surface 180A3 of the first member 180A glides over wet concrete. The second member 180B may include a front surface 180B2 and a back surface 180B3 spaced apart along the second direction 170B to define a second member depth or thickness T(SM) (FIG. 4A).

Figure 5:
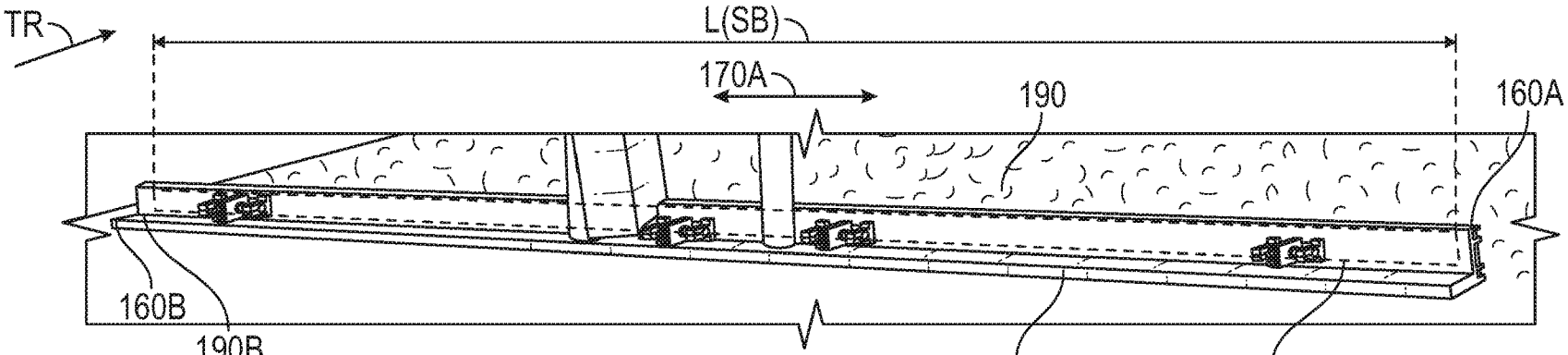
FIG. 5 shows the base bar as shown in FIG. 3 and further shows a base bar (in dashed lines) of the screed because the screed bar is located on the front side of the base bar.

As shown in FIG. 5, a screed bar (or SB) 190 may be disposed against the front side of the base bar 160 and be configured to move, or oscillate, against the base bar 160, along the first direction 170A. More specifically, the screed bar 190 may be configured to oscillate against the front surface 180A3 of the second member 180B of the base bar 160 within an oscillatory range of movement (or oscillatory amplitude). For example, the oscillatory range of movement may be one inch, as a non-limiting example. The screed bar 190 may be the same material as the base bar 160. The screed bar 190 may have a first end 190A and a second end 190B spaced apart from each other in along the first direction 170A, to define a screed bar length L(SB) that may be less than the base bar length L(BB) (FIG. 3). The screed bar 190 may be configured such that it remains between the first and second ends 160A, 160B of the base bar 160 throughout the oscillatory range of movement. That is, a difference in length between the base bar 160 and the screed bar 190 may be the same as or greater than oscillatory range of movement.

Figure 6A:
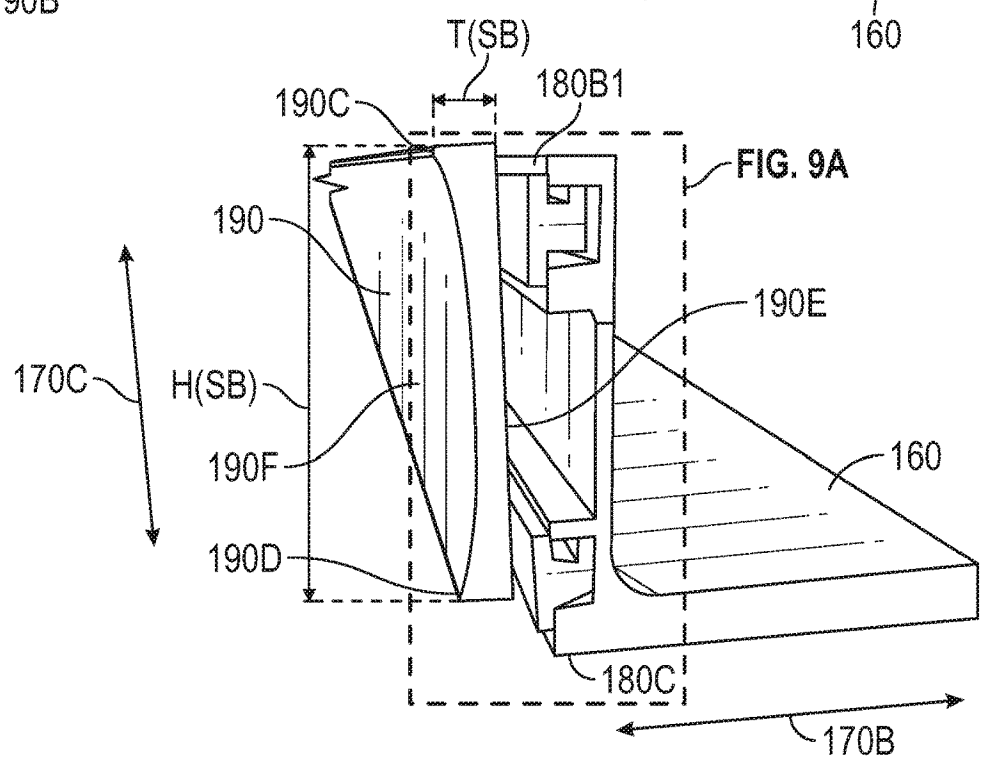
FIG. 6A shows the base bar as shown in FIG. 4 and labels features the base bar attached to the base bar, where tracks that receive wear strips have a rectangular cross section.
Figure 6A:
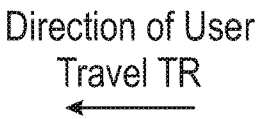
Figure 6B:
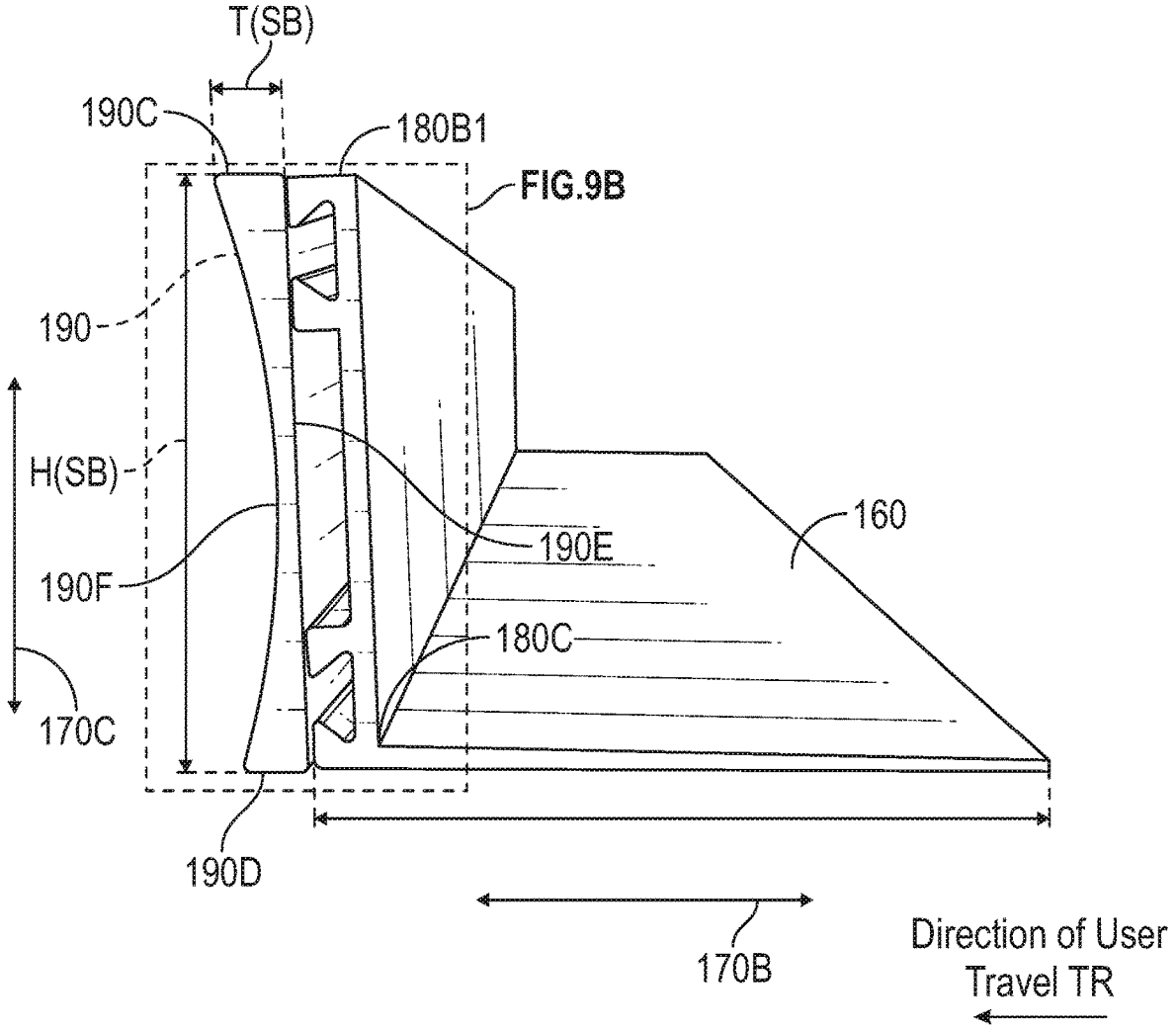
FIG. 6B shows the base bar as shown in FIG. 4 and labels features the base bar attached to the base bar, where tracks that receive wear strips have a trapezoidal cross section.

As shown in FIGS. 6A and 6B, the screed bar 190 may include a top end 190C and a bottom end 190D spaced apart from each other along the third direction 170C, to define a screed bar height H(SB). The screed bar 190 may include a back surface 190E and a front surface 190F spaced apart from each other along the second direction 170B, to define a screed bar depth or thickness T(SB). The screed bar height may be the same as the base bar height H(BB), e.g., between the joint 180C of the base bar 160 and the outer end 180B1 of the second member 180B of the base bar 160. The front surface 190F of the screed bar 190 may be concave. With this configuration, the screed bar 190 may be curved in shape, such as a shovel, snowplow or moldboard, to decrease backpressure while moving the screed 110 against wet concrete, e.g., to enable concrete to roll over the screed more easily. The top end 190C of the screed bar 190 may be aligned in the third direction 170C (heightwise) with the outer end 180A1 of the second member 180B of the base bar 160. The screed bar 190 may be a same size in the third direction 170C (heightwise) as the second member 180B of the base bar 160. With this configuration the second member 180B may glide along the wet concrete and while the screed bar 190 engages the wet concrete.

Figure 7:
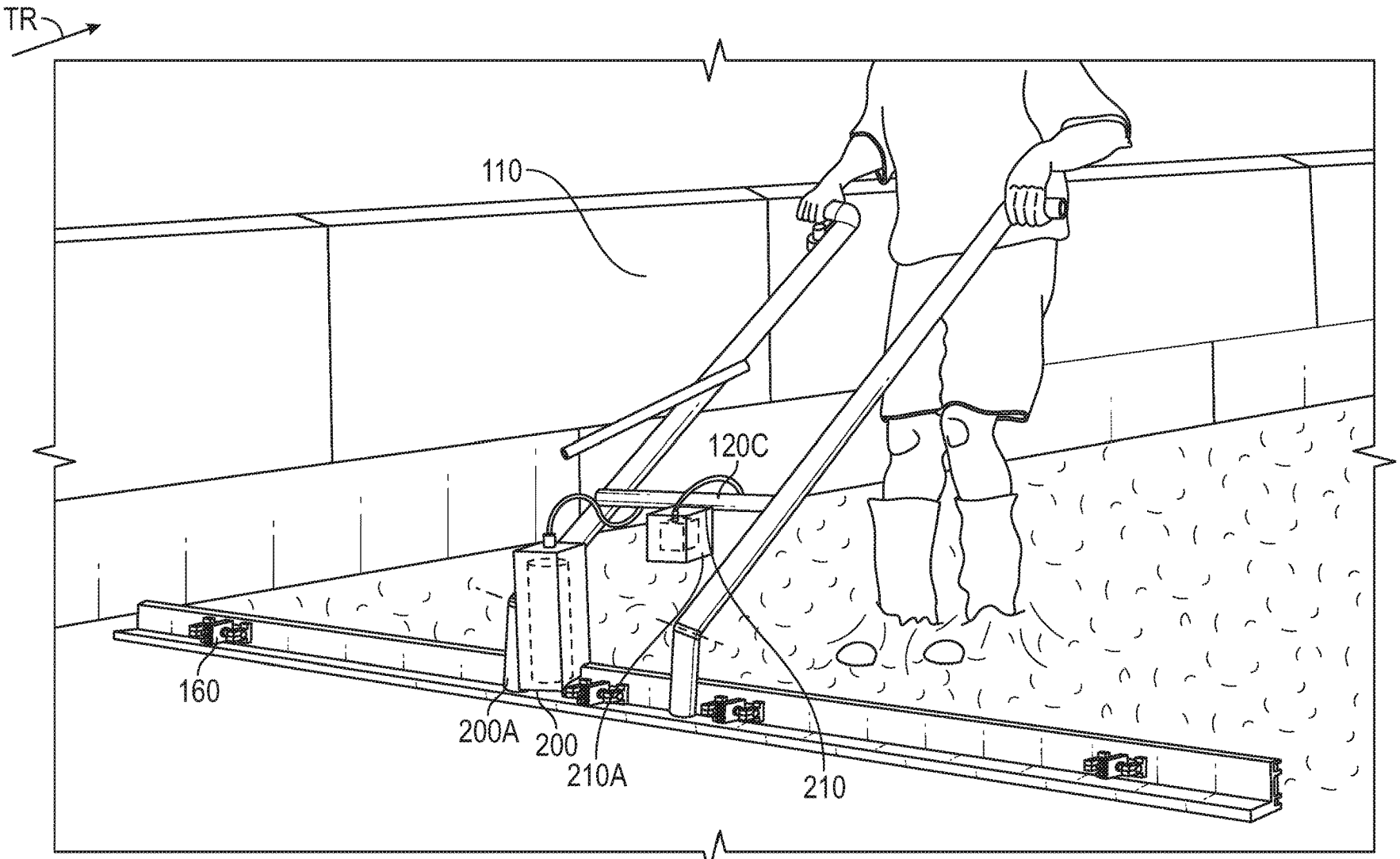
FIG. 7 shows the screed as shown in FIG. 1 and labels features of a motor and power supply.

Turning to FIG. 7, the motor 200 may be supported by the screed 110. The motor 200 may be operationally connected to the screed bar 190, as discussed in greater detail below, to oscillate the screed bar 190. As shown, the motor 200 may be supported in a motor housing (or motor tray) 200A that is fixed to the base bar 160. A power supply 210 may be supported by the screed 110 and electrically coupled to the motor 200. As shown, the power supply 210 may be supported in a power supply housing (or power supply tray) 210A that is fixed to the crossmember 120C. In one embodiment, the power supply 210 is a battery mounted directly to the motor 200.

Figure 8A:
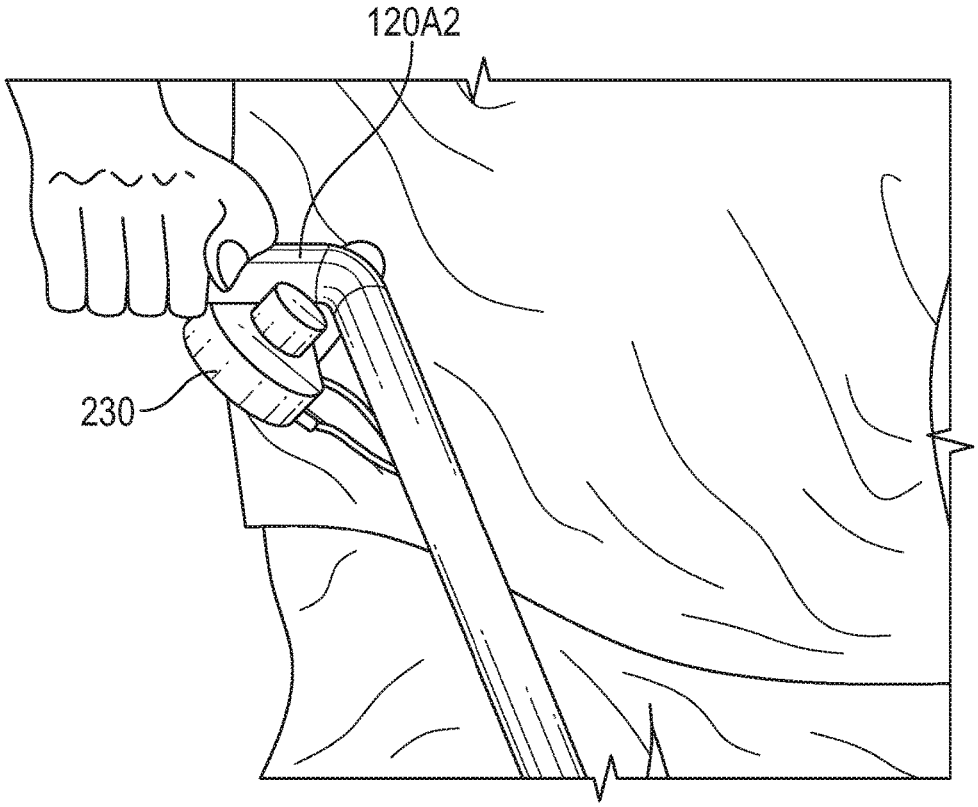
FIG. 8A shows motor controls secured to the handle structure.
Figure 8B:
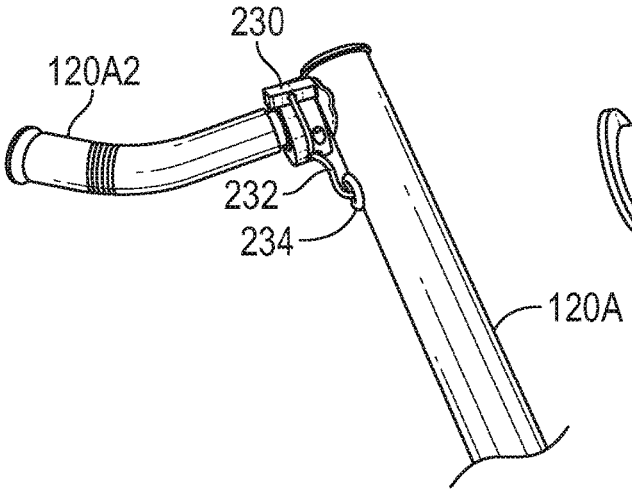
FIG. 8B shows the motor controls secured to a curved handle.
Figure 8C:
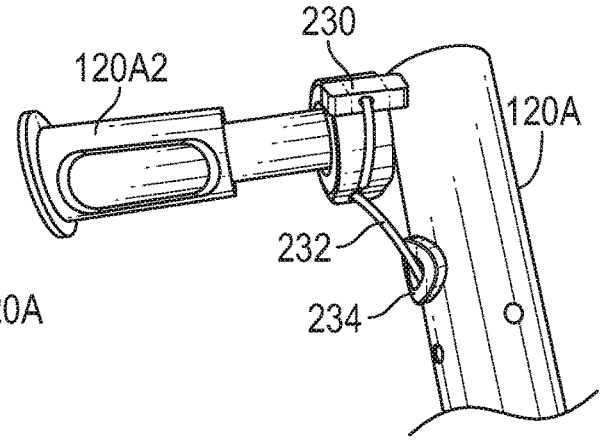
FIG. 8C shows motor controls secured to a straight, rubber coated handle.

As shown in FIG. 8A-8C, a motor control 230 may be secured to one of the handle portions 120A2, 120B2, and operationally connected to the motor 200. As shown, the motor control 230 is connected to the first handle portion 120A2. The motor control 230 may be pivot or shift lever configured to turn the motor 200 on and off as well as to change a rotational speed of the motor 230 depending on conditions of the wet cement. The handle portions 120A2, 120B2 may be in the form of curved grips (FIG. 8B) or straight and rubber coated grips (FIG. 8C). A power able 232 may be wired through the handle member 120A to which the control 230 is attached, which may be connected to the motor 200. That is, the power cable 232 may be snaked through the handle member 120A, from the motor control 230, via an aperture 234 near the motor control 230 to an aperture near the motor 200.

Figure 9A:
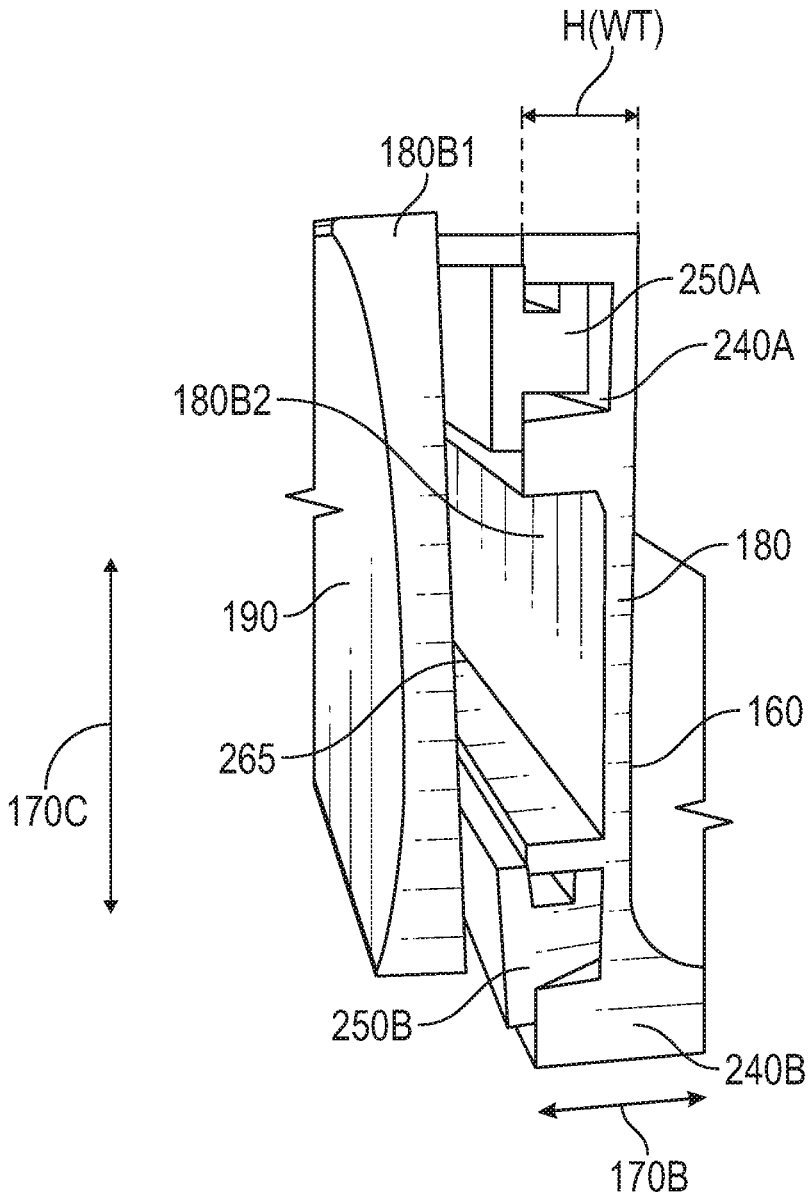
FIG. 9A shows a detail of FIG. 6, identifying a wear strip track formed in the base bar, where tracks that receive wear strips have a rectangular cross section.
Figure 9B:
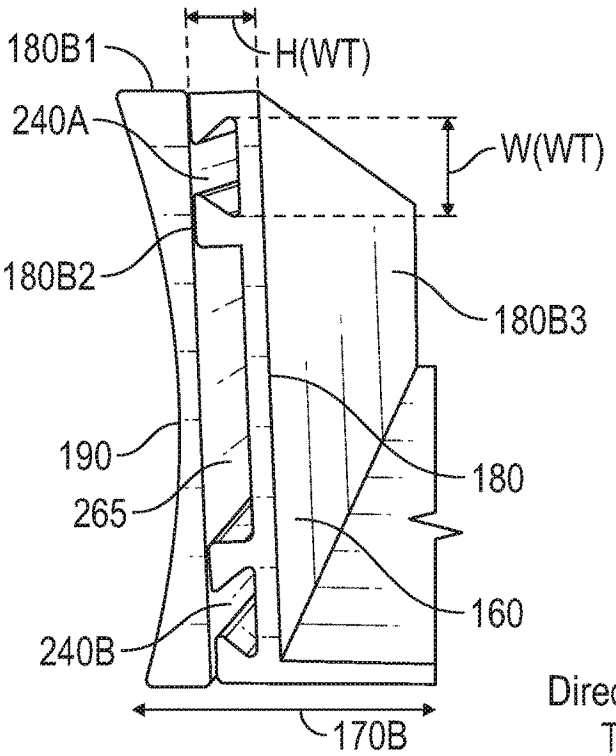
FIG. 9B shows a detail of FIG. 6, identifying a wear strip track formed in the base bar, where tracks that receive wear strips have a trapezoidal cross section.

Turning to FIGS. 9A and 9B, the base bar 160 includes a wear strip track or channel 240A formed in the front surface 180B2 of the second member 180B of the base bar 160. As shown in the figures, the first track 240A extends inwardly in the second direction 170B (depthwise) from the front surface 180B2 toward the back surface 180B3 of the second member 180B to define a wear track height H(WT). The wear track width W(WT) is defined along the third direction 170C. As shown in FIG. 9A, a cross-sectional shape of the first track 240A may be a U-shape. As shown in FIG. 9B, a cross-sectional shape of the first track 240A may be a trapezoidal-shape, which expands towards the back surface 180B3 of the second member 180B. As shown in the figures, the first track 240A may be formed near the outer end 180B1 of the second member 180B of the base bar 160. FIGS. 9A and 9B also show the screed bar 190, a center channel 265 (discussed below) and a second wear strip track 240B (discussed below) and top and bottom wear strips 250A, 250B (shown in FIG. 9A and discussed below).

Figure 10:
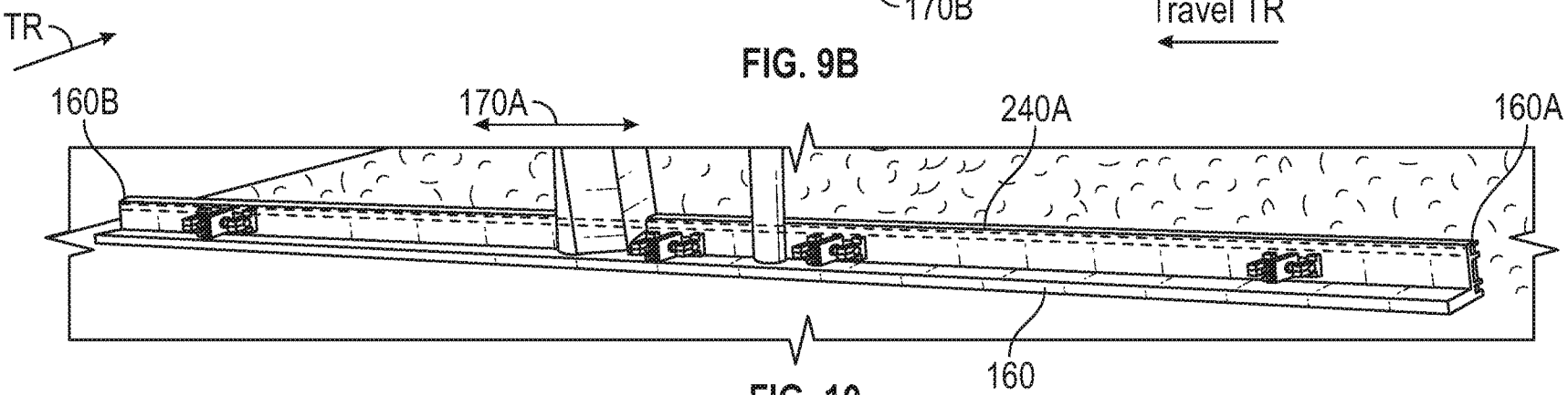
FIG. 10 shows the base bar as shown in FIG. 3 and further shows the wear strip track (in dashed lines) of the screed.

As shown in FIG. 10, the first track 240A may extend in the first direction 170A (longitudinally) along the second member 180B of the base bar 160 from the first end 160A to the second end 160B of the base bar 160. With this configuration a first track 240A may have a length that is substantially the same as the base bar length L(BB) (FIG. 3).

Figure 11:
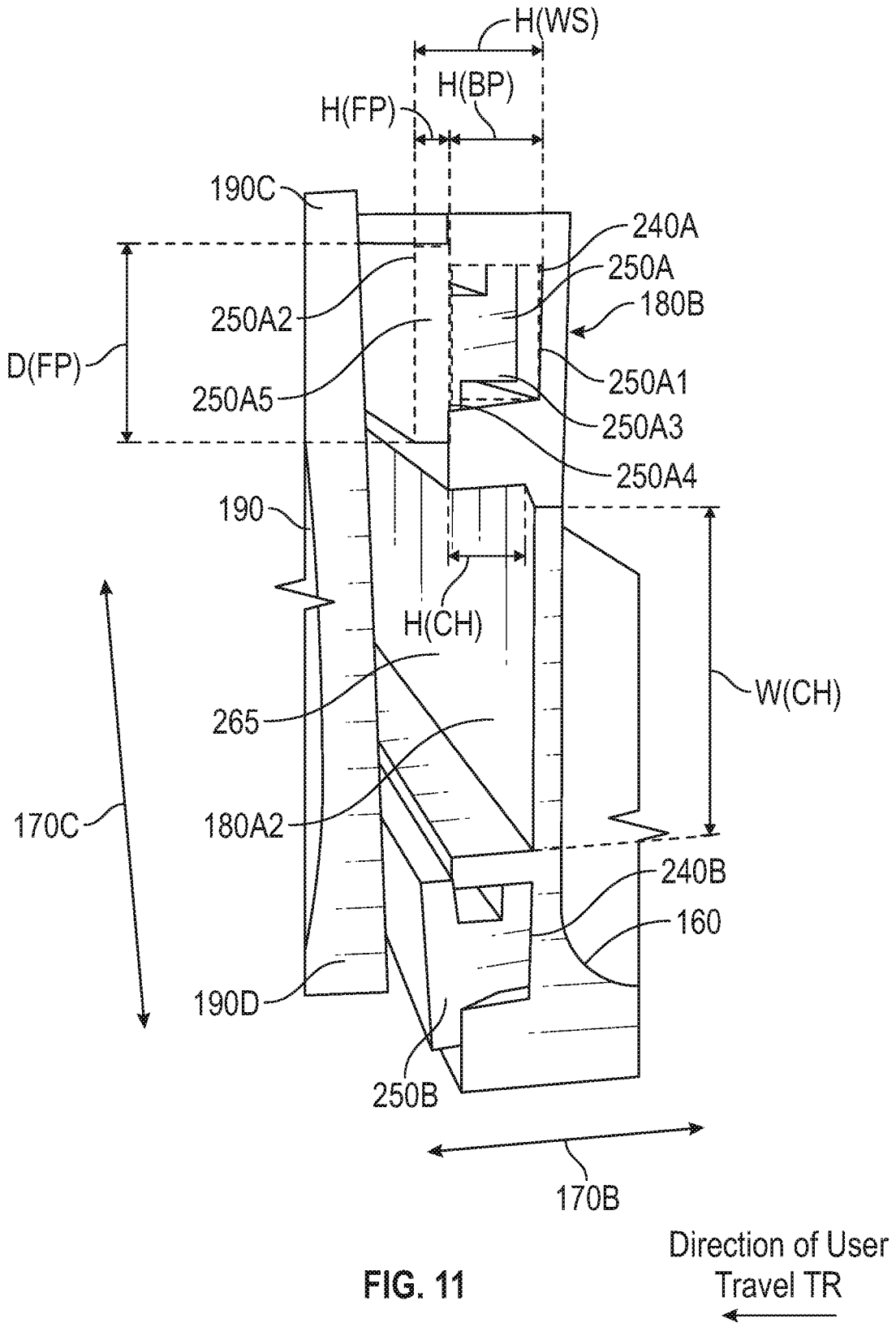
FIG. 11 shows the detail of FIG. 6, identifying wear strip tracks formed in the base bar and wear strips within the tracks.

As shown in FIG. 11, a first wear strip (or WS) 50A may be secured within the first track 240A to position the first wear strip 250A between the screed bar 190 and the base bar 160. The first wear strip 250A, for wear and friction reduction, may be HDPE (high density polyethylene). The first wear strip 250A may extend along the first direction to 170A (longitudinally), not shown, though the schematic illustration of the tack 240A in FIG. 10 is equally applicable to the first wear strip 250A), to define a first wear strip length that is substantially the same as base bar length L(BB) (FIG. 3).

As further shown in FIG. 11, the first wear strip 250A may extend from a back end 250A1 to a front end 250A2 along the second direction 170B, to define a first wear strip height H(WS). Between the back and front ends 250A1, 250A2, the first wear strip 250A may define a T-shape cross section with a base portion (or BP) 250A3 and a flange portion (or FP) 250A5. The base portion 250A3 extends from the back end 250A1 to an intermediate location 250A4, to define a base portion height H(BP). The base portion 250A3 may be sized and shaped to seat within the first track 240A. The flange portion 250A5 may extend from the intermediate location 250A4 to the front end 250A2 of the first wear strip 250A, to define a flange portion height H(FP). The flange portion height H(FP) may be smaller than the base portion height H(BP) and the flange portion 250A5 may be wider W(FP), e.g., in the third direction 170C, than the base portion 250A3.

Figure 11A:
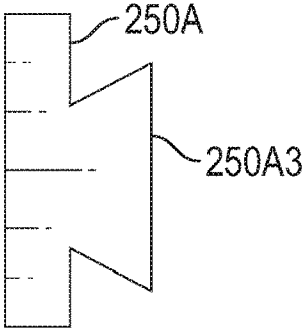

As shown in FIG. 11A, the base portion 250A3 of the first wear strip 250A, for the first track 240A that is shaped as shown in FIG. 9B, is trapezoidal. This configuration locks the first wear strip 250A along the second direction 170B (depthwise) within the first track 240A. The rest of the first wear strip 250A in FIG. 11A is shaped the same as that in FIG. 11.

Turning back to FIG. 11, in the non-limiting illustrated embodiment, the flange portion width W(FP) of the first wear strip 150A2 (e.g., in the third direction 170C) may be less than twenty five percent (25%) of the height H(BB) of the base bar 160 (FIG. 4A). The front surface 180A3 of the second member 180B of the base bar 160 may define a second track 240B that has a same size and shape as the first track 240A, and which may be spaced apart from the first track 240A along the third direction 170C. The first and second tracks 240A, 240B may be spaced apart from each other along the third direction 170C so that the first track 240A is aligned with the top end 190C of the screed bar 190 and the second track is aligned with the bottom end 190D of the screed bar 190. The screed 110 may include a second wear strip 250A that has a same size and shape and is formed of the same material as the first wear strip 250A and which is seated in the second track 240B Between the first and second tracks 240A, 240B, the second member 180B may define a center channel (CH) 265 formed into the front surface 180A2 of the second member 180B, having a center channel height H(CH) in the second direction 170B that is the same as the wear track height H(WT) (FIGS. 9A, 9B), and a width W(CH) in the third direction 170C that is greater than the wear track width W(WT). The center channel 265 allows for mounting the components (e.g., mounting hardware for one or more of the handles, motor, battery, and rod mounts and bearing mounts) to the base bar 160 without interfering with the operation of the screed bar 190.

Figure 12:
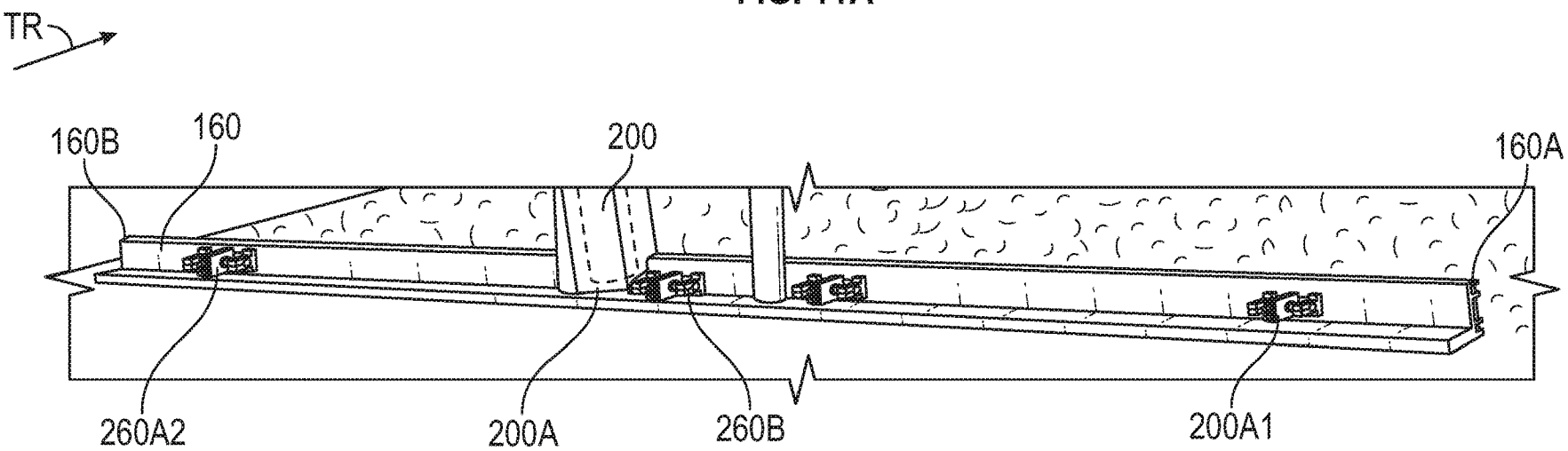
FIG. 12 shows the base bar as shown in FIG. 3 and further identifies guide systems that guide the screed bar against the base bar.

As shown in FIG. 12, the screed 110 includes linear guide systems generally referenced as 260, including outer guide systems 260A and a center or middle guide system 260B that are the same as each other except as identified below. The middle guide system 260B may be located near the motor housing 200A and may be operationally coupled to the motor 200 as indicated below. A first outer guide system 260A1 is located near the first end 160A of the screed bar 160. A second outer guide system 260A2 is located near the second end 160B of the screed bar 160.

Figure 14:
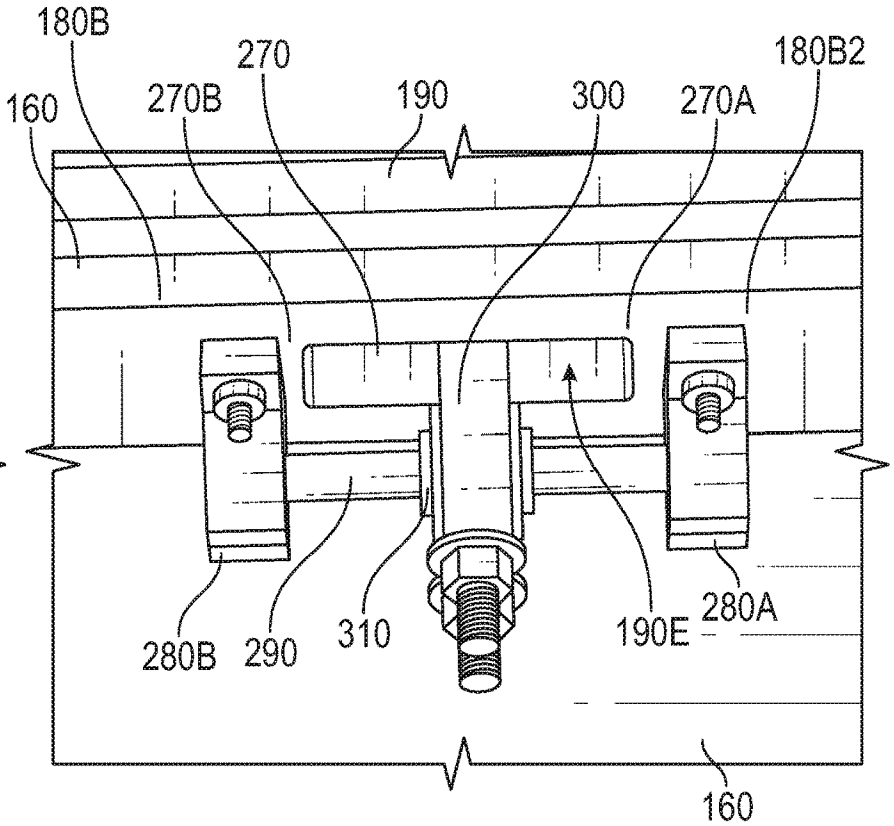
FIG. 14 is a top view of an outer guide system.
Figure 13:
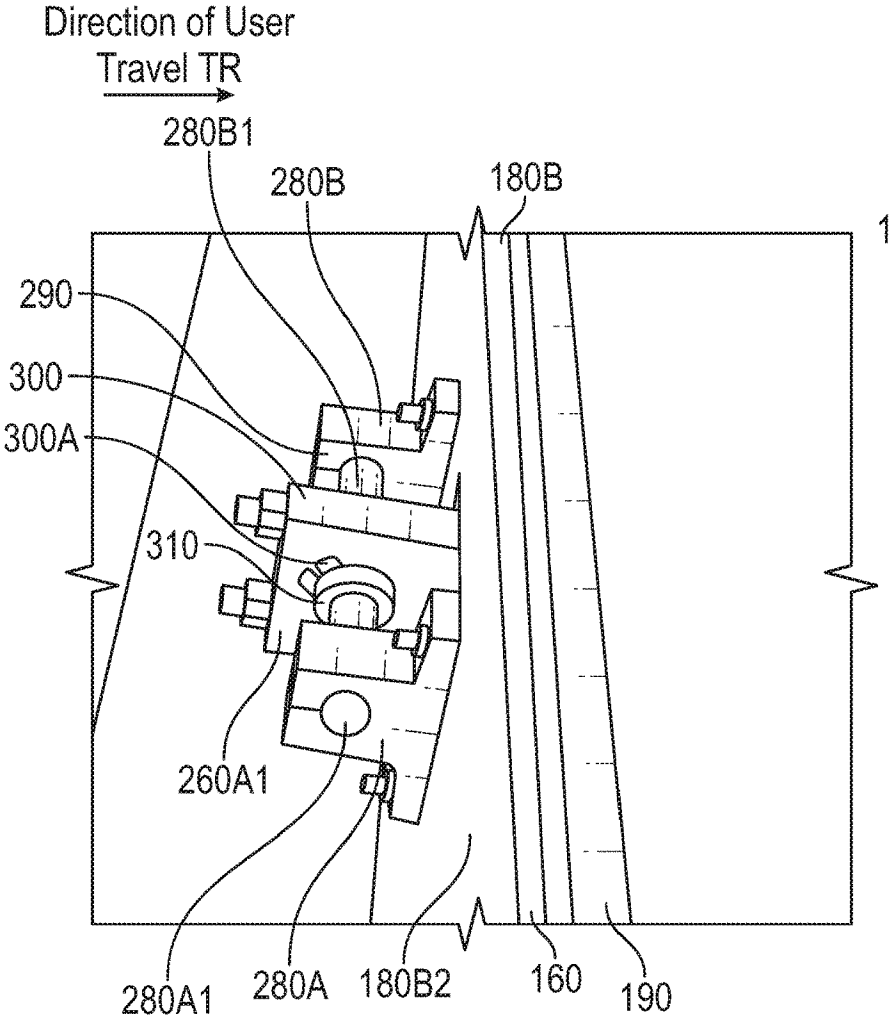
FIG. 13 is a perspective view of an outer guide system.

Turning to FIGS. 13 and 14A, the first outer guide system 260A1 is shown. A slot 270 is defined in the second (upright) member 180B of the base bar 160. The slot 270 extends along the first (longitudinal) direction 170A to define a first end 270A of the slot 270 and a second end 270B of the slot 270. A first rod mount (or post) 280A is connected to the back surface 180B2 of the second member 180B of the base bar 180 at the first end 270A of the slot 270. A second rod mount 280B is connected to the back surface 180B2 of the second member 180B at the second end 270B of the slot 270. First and second bar apertures 280A1, 280B1 are defined in the first and second bearing rod mounts 280A, 280B. A slide bearing rod 290 extends from the first rod mount 280A to the second rod mount 280B and is supported within the first and second bar apertures 280A1, 280B1.

A slide bearing mount 300 (or standoff) extends from the back surface 190E of the screed bar 190 (FIGS. 6A and 6B), through the slot 270. A guide aperture 300A is defined in the slide bearing mount 300, through which the slide bearing rod extends 290. A slide bearing 310 is disposed within the guide aperture 300A, which is configured to engage the slide bearing rod 290. This configuration permits only linear movement (e.g., sliding) of the screed bar 190 against the base bar 160.

Figure 15:
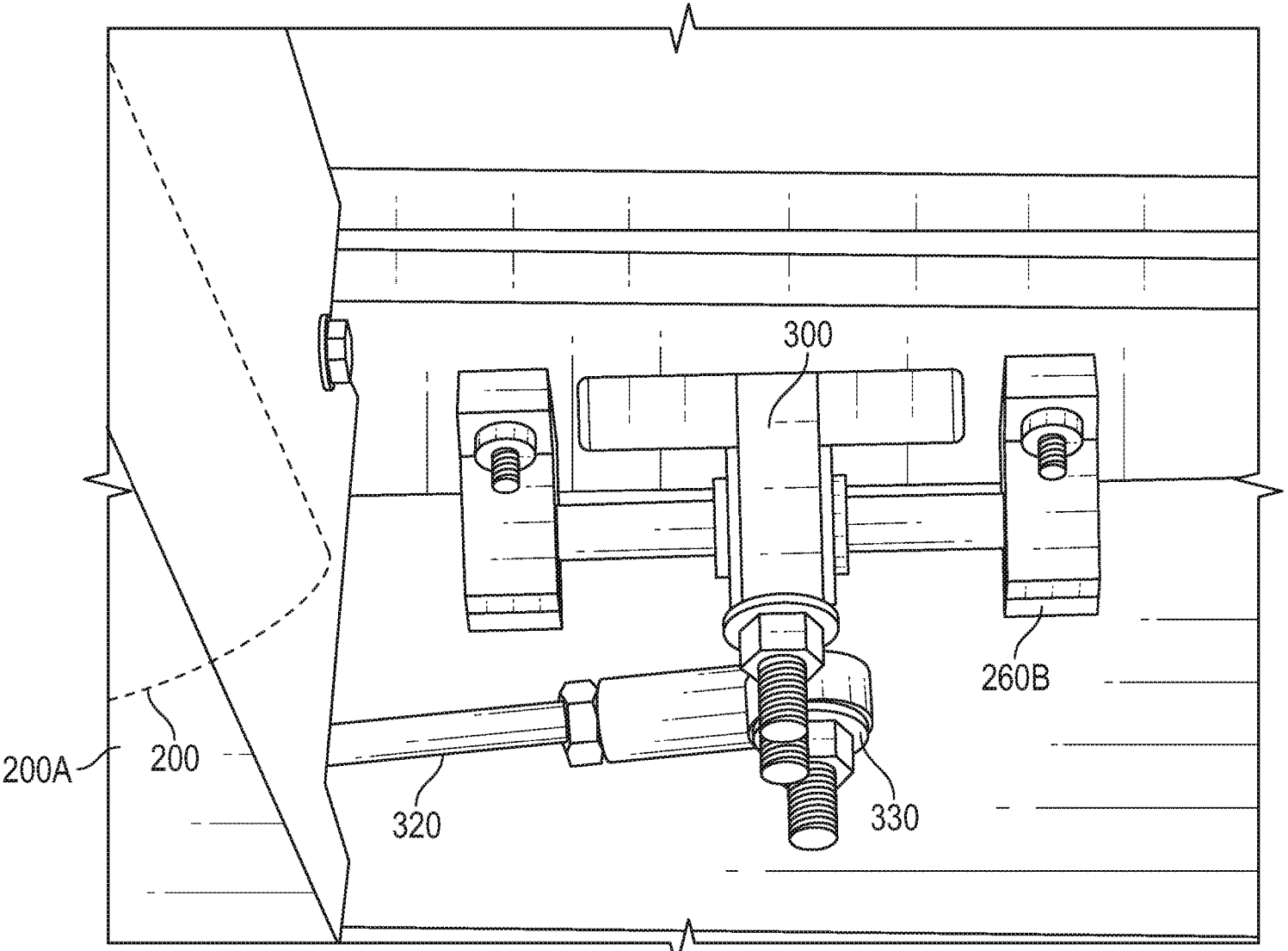
FIG. 15 is a top view of a middle guide system.

Turning to FIG. 15, the middle guide system 260B is shown. As indicated, the middle guide system 260B is configured the same as the outer guide systems 260A except as identified herein. The motor 200 may be operationally coupled to the slide bearing mount 300 of the middle guide system 260B. This connection may be provided by a link 320 with a pivotal connection 330 to the slide bearing mount 300 and a rotary connection to the motor 200, through the motor housing 200A. That is, the center guide system 260B is a lead guide system and the outer guide systems 260A1, 260A2 are follower guide systems.

With this connection, the motor rotational output is configured to oscillate the screed bar 190. That is, the link 320 is connected to move by action of the motor 200 between minimum and maximum displacements along the first direction 170A, equivalent to the oscillatory amplitude. Movement of the link 320 results in oscillations of the slide bearing mount 300 of the middle guide system 260B, which moves the screed bar 190 accordingly. The screed bar 190 is linearly guided to move only along the first direction 170A due to action of the guide systems 260.

Thus, the above embodiments provide a concrete screed that is capable of instant stopping and restarting on a wet slab and is light enough so it does not sink or damage a finished surface. The screed is electrical and is capable of producing minimal noise, no exhaust pollutants, does not require throttle cables, pull cords, oil, fuel or spark plugs of other screeds. The base bar of the screed is capable of gliding over wet concrete peaks or troughs and providing a level and finished surface.

Turning to FIGS. 16-24, another embodiment of the concrete screed 110 is shown. As explained below, this embodiment is suitable when laying concrete between forms 500, such as forms 500 placed on a walking path where concrete will be utilized as a walkway, for example, a sidewalk. Sidewalks are a relatively big percentage of concrete work. Due to over vibrations at the surface with gas-powered screeds, the losing of left to right pitch, concrete falling out of any voids that may be below the sidewalk form, wedges shaking loose and other issues, the work produce may be less than ideal. The disclosed screed 110 addresses issues with known screeds.

Aspects of the screed 110 in FIGS. 16-24 are the same as identified above unless indicated otherwise. In addition, where aspects of the screed 110 in FIGS. 16-24 differ from those discussed above, the different aspects may be interchanged without departing from the scope and breath of the embodiments.

Similar to the above disclosed embodiment, the screed 110 has a base bar 160 and screed bar 190, with wear strips 250 therebetween and are operationally connected to each other via outer and middle guide systems 260A1, 260A2, 260B between the first and second ends 160A, 160B of the base bar 160 (see above disclosure).

Figure 16:
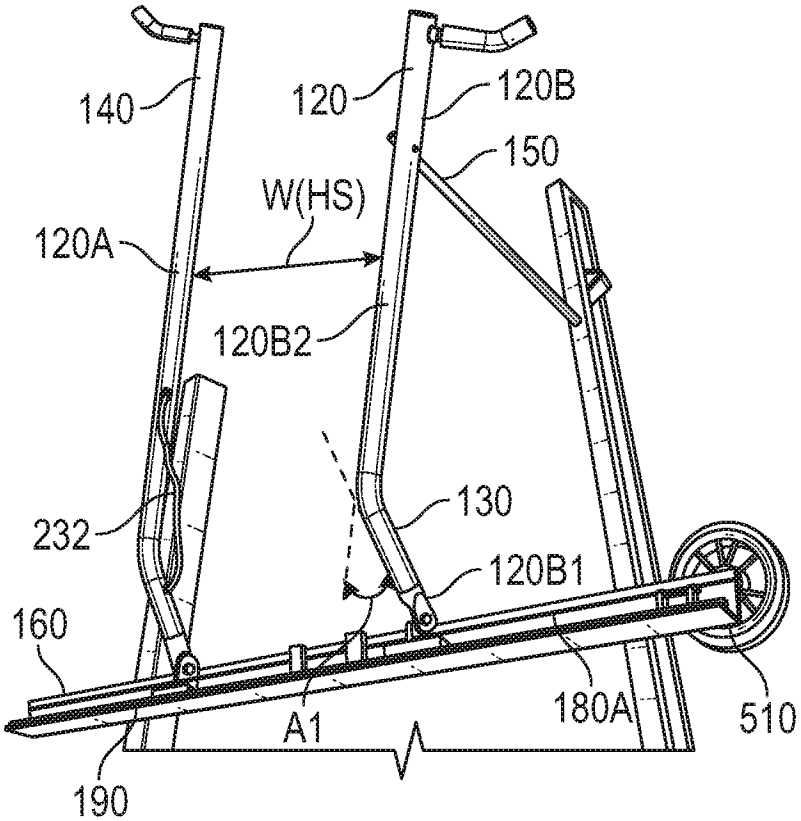
FIG. 16 shows an embodiment of the screed that is useful for leveling concrete between forms.

As shown in FIG. 16, connected at the first end 160A of the base bar 160, which may be a left end when standing behind the base bar 160, to the bottom member 180A of the base bar 160, is a guide wheel 510. An axis of rotation of the guide wheel 510 is though the bottom member 180A of the base bar 160. As such, the guide wheel 510 spins against the bottom member 180A of the base bar 160. The guide wheel 510, positioned below the base bar 160, may engage one of the forms 500. This way, when moving the screed 110 along wet concrete between the forms 500, the guide wheel 510 guides the screed 110 to move in a direction parallel to the forms 500. It is to be appreciated that the base bar 160 and screed bar 190 have a length that is at least as great as the distance between the forms 500.

The handle structure 120 is provided having a lower end 130 and an upper end 140. The handle members 120A, 120B are separated from each and are parallel to each other between lower and upper ends 130, 140. The upper end 140 of the members 120A, 120B is angulated, e.g., disposed at an acute angle A1, relative to the lower end 130 so that the upper end 140 is closer to the guide wheel 510. That is, the upper end 140 bend toward a same side of the screed 110 as the guide wheel 510. As a result, the user can urge the screed 110 while walking alongside it as compared to walking in front or behind it. Specifically, the user can walk in line with the guide wheel 510, adjacent to the track 500 against which the guide wheel 510 rolls. The handle structure 120 may be connected to the screed bar 160 via a pivotal configuration as shown in FIGS. 1B-1C so that the straight handle structure shown in FIG. 1A may be connected, depending on the application.

The support 150 on the screed 110 is disposed on the handle member 120A that is on a same side of the base bar 160 as the guide wheel 510. This configuration enables resting the support 150 against the track 500 or adjacent to the wet concrete between the forms 500.

Figure 17:
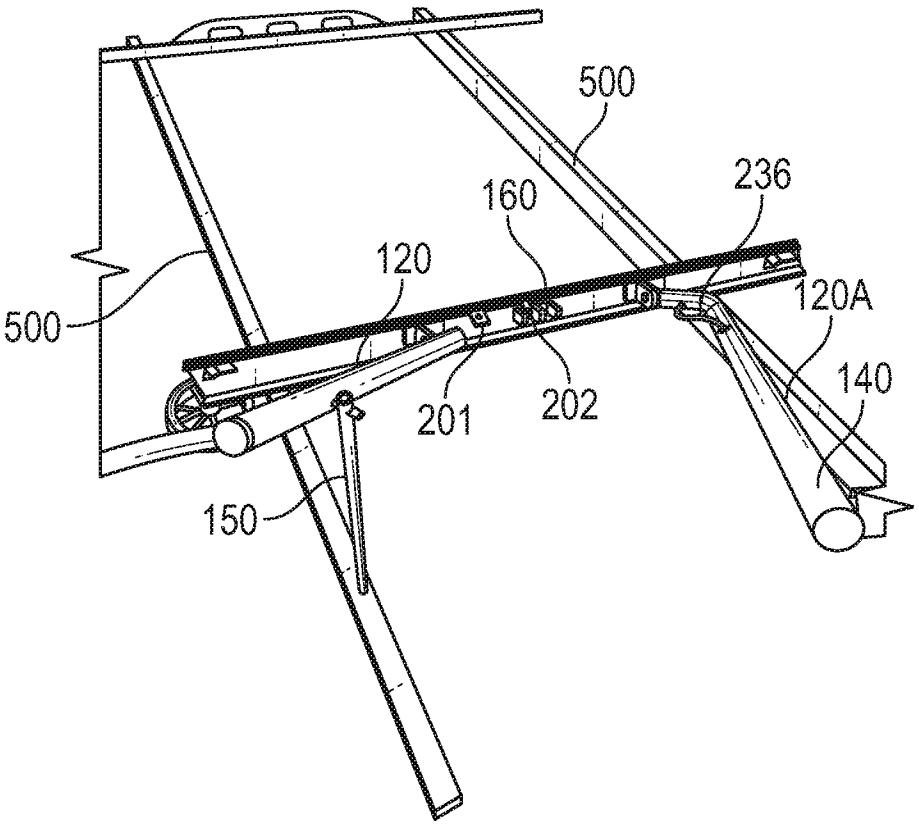
FIG. 17 shows another view of the embodiment of FIG. 16.
Figure 19:
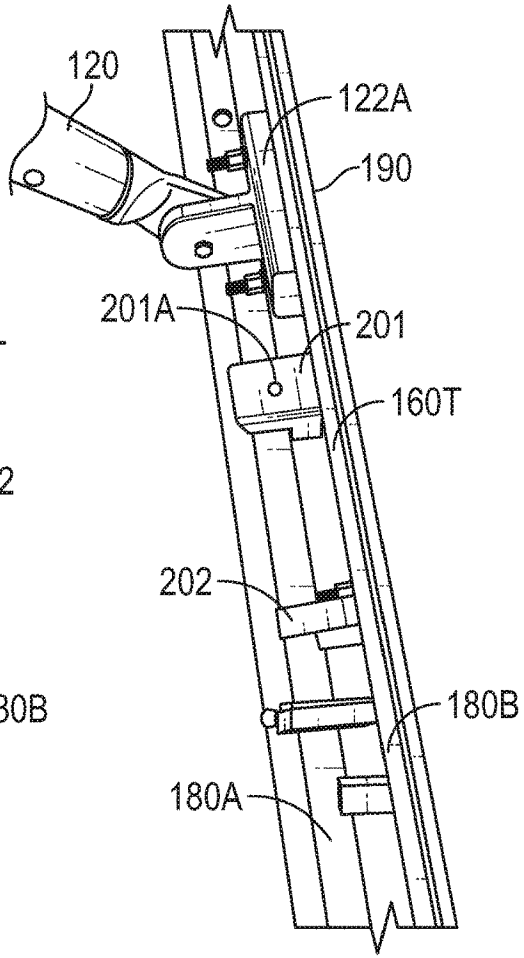
FIG. 19 shows another view of the motor housing mount for the embodiment shown in FIG. 16.
Figure 18:
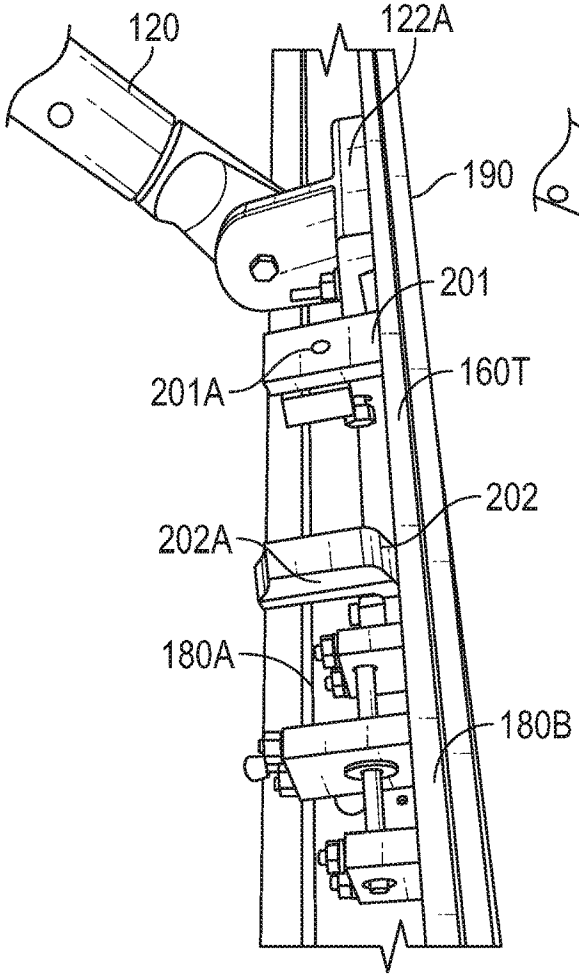
FIG. 18 shows a view of a motor housing mount for the embodiment shown in FIG. 16.

Turning to FIGS. 17-19, the motor control wires 232 are snaked through the handle structure 120A2 as indicated. The motor control wires 232 may terminate at quick release 236, which may be an SAE bullet connector (SAE meaning the SAE International, formerly named the Society of Automotive Engineers). The motor housing 200A may be removably connected to the upright member 180B of the base bar 160. For example, a pair (e.g., first and second) of support brackets 201, 202 may be connected, e.g., by welding, bolting or otherwise, to the upright member 180B of the base bar 160, between the pivot brackets 122A, 122B. The support brackets 201, 202 may extend over the bottom member 180A of the base bar 160 and define first and second platforms which are level with a top 160T of the upright member 180B of the base bar 160. The first support bracket 201 may define a platform with a center bore 201A, which opens toward the bottom member 160B of the base bar 160. The second support bracket 202 may define a slot 202A, e.g., which opens in the longitudinal direction.

Figure 20:
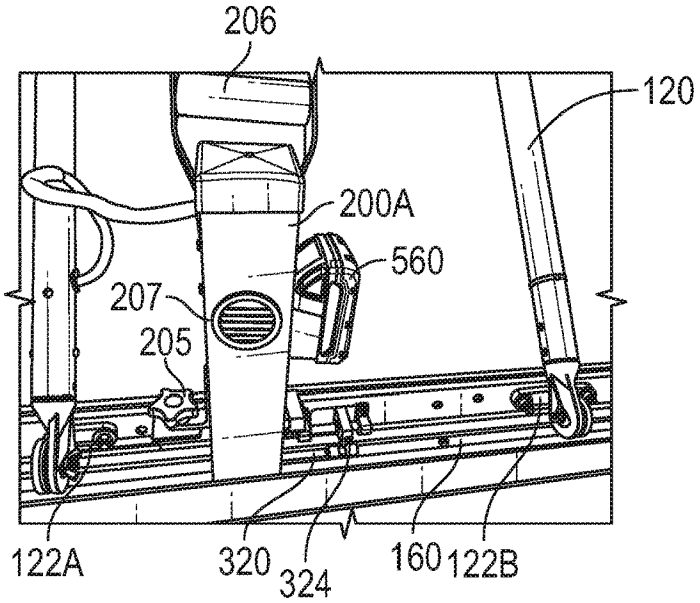
FIG. 20 shows the motor housing mount that is mounted to the screed shown in FIG. 16.
Figure 21:
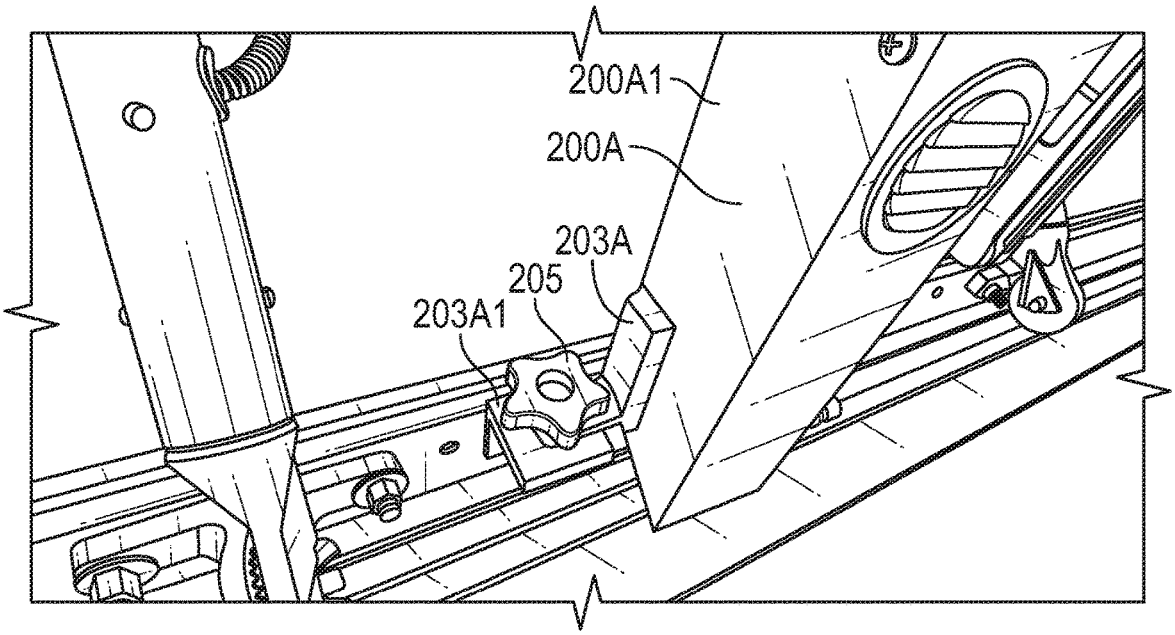
FIG. 21 shows another view of the motor housing mount that is mounted to the screed shown in FIG. 16.
Figure 22:
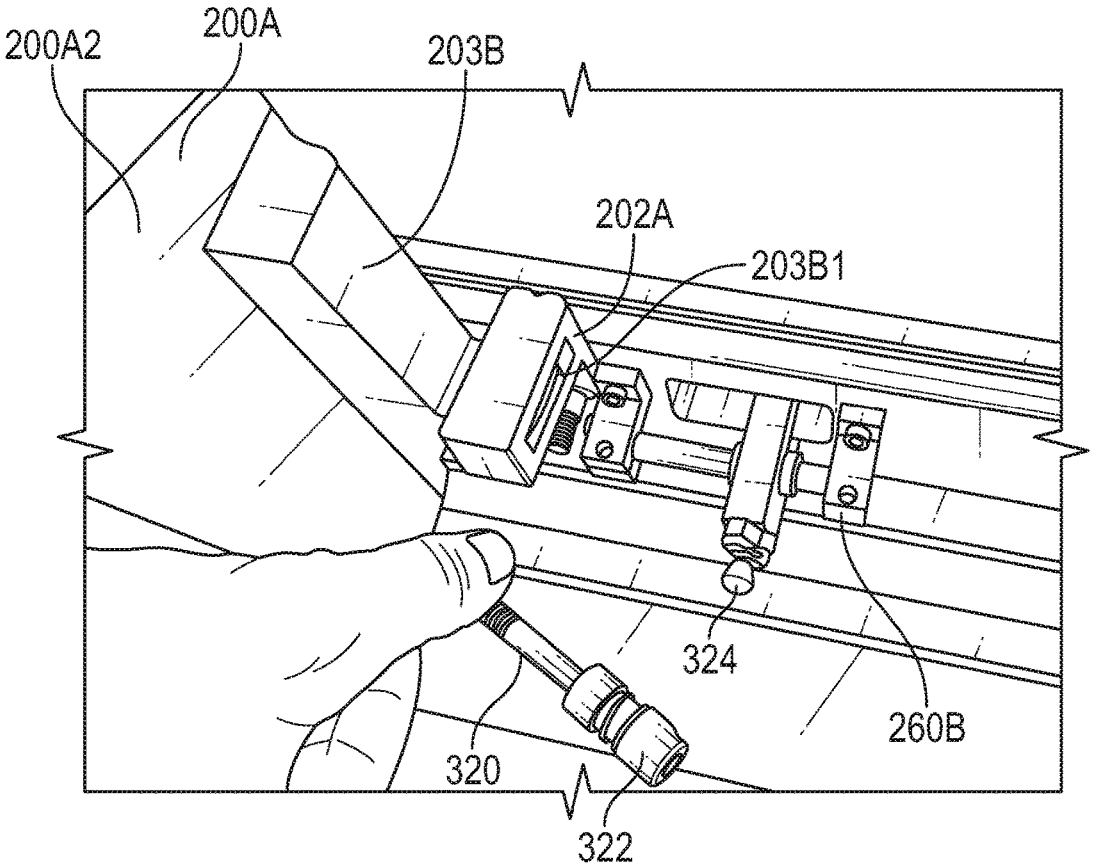
FIG. 22 shows a quick release motor link connected to the screed shown in FIG. 16.

Turning to FIGS. 20-22, the motor housing 200A has opposing sides 200A1, 200A2 with first and second L-brackets 203A, 203B connected, e.g., by welding, so that each forms an outwardly extending arm 203A1, 203B1. The first arm 203A1 may have a center hole through which a shaft of a handle screw 205 may extend, and pass through the bore 201A in the first bracket 201, and which may be secured by a fastener, e.g., connected to a bottom side of the bracket 201. The second arm 203B1 may extend through the slot 202A. This configuration releasably connects the motor housing 200A to the screed 110. It is to be appreciated that the handle screw 205 is connected after the second arm 203B1 is slid into the slot 202A when connecting the housing 200A. The housing 200A may have a handle 206 and a louvered motor vent 207 in a housing sidewall.

Figure 23:
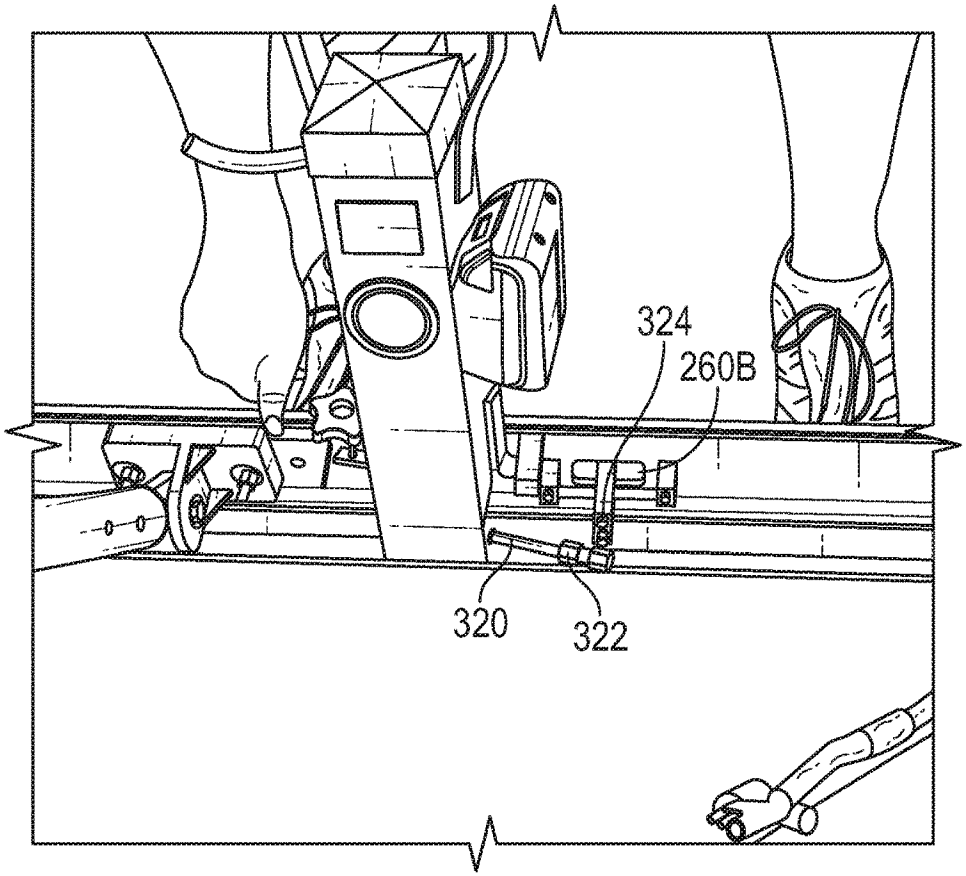
FIG. 23 is another view of the quick release motor link connected to the screed shown in FIG. 16.

As shown in FIGS. 22 and 23, the motor link 320 of the motor 200 may be connected to the slide bearing mount 300 of the middle guide system 260B via a spring-loaded quick release mechanical connector 322. The slide bearing mount 300 of the middle guide system 260B may include a quick release ball pivot 324 to enable connecting with the quick release connector 322. The connector 322 may be a ball socket connector with a female threaded shaft of the motor link 320.

Figure 24:
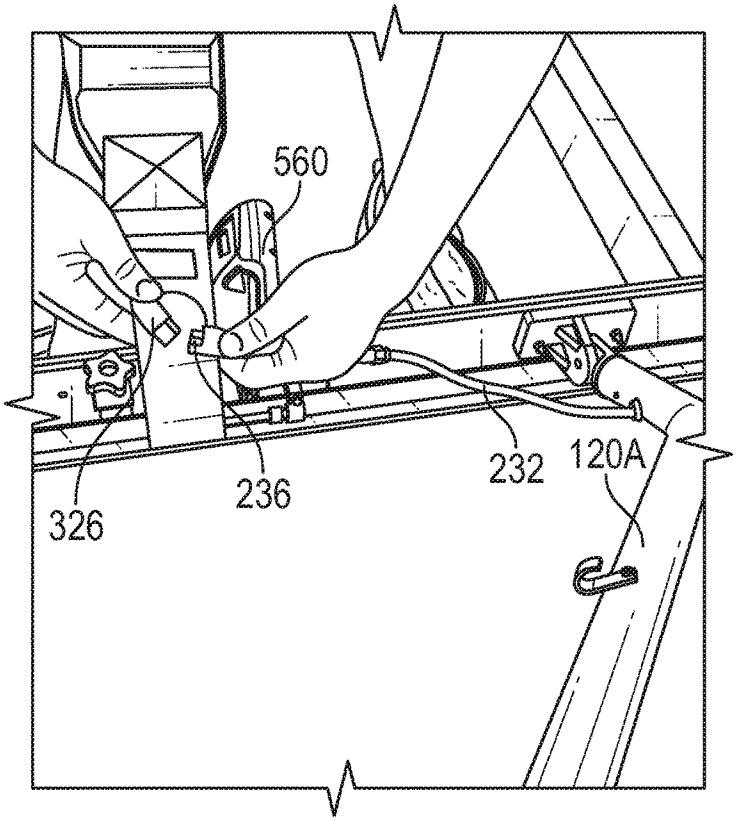
FIG. 24 shows a quick release electrical connector for connecting the motor to motor controls of the screed shown in FIG. 16.

As shown in FIG. 24, the motor housing 200A may have a quick release electrical connector 326, which may also be an SAE bullet connector. This connector 326 may connect with the quick connector 236 of the motor control wires 232 that is snaked through the handle member 120A. A rechargeable, quick-connect battery 327 may connect to the motor 200 through the housing 200A. The battery 560 may be similar to a 20V rechargeable battery pack utilized in common power tools.

With the above configuration, the battery, the motor 200 and the handles 120A, 120B maybe swapped out of the screed 110 and replaced as needed. Interchangeable batteries 327 are useful for longer screed jobs. Removing the motor 200 is helpful for replacing the motor 200 if it should break or for transportation of the screed 110 to protect internal electronics. Removing the handles 120A, 120B may also be convenient for transporting the screed 110 as well as enabling the use of different handles depending on job requirements. For example jobs that accept walking in-line with the screed 110 may be suitable for the utilization of straight handles (FIG. 1) while jobs that require the user to be offset from the screed 110 may require utilization of the angled handles (FIG. 16).

Turning to FIGS. 25-31, another embodiment of the screed 110 is a handled configuration. Aspects of the screed 110 in FIGS. 25-31 are the same as identified above unless indicated otherwise. In addition, where aspects of the screed 110 in FIGS. 1-24 differ from those discussed above, the different aspects may be interchanged without departing from the scope and breath of the embodiments.

Figure 25:
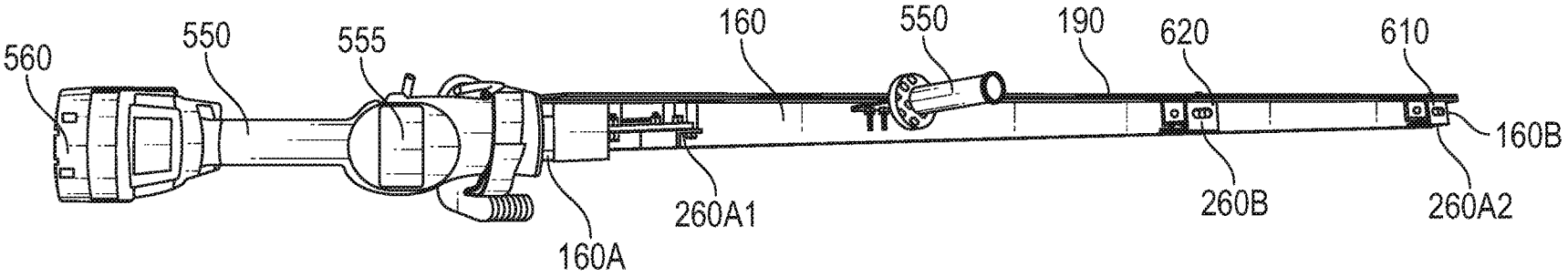
FIG. 25 shows a handled embodiment of the screed.
Figure 26:
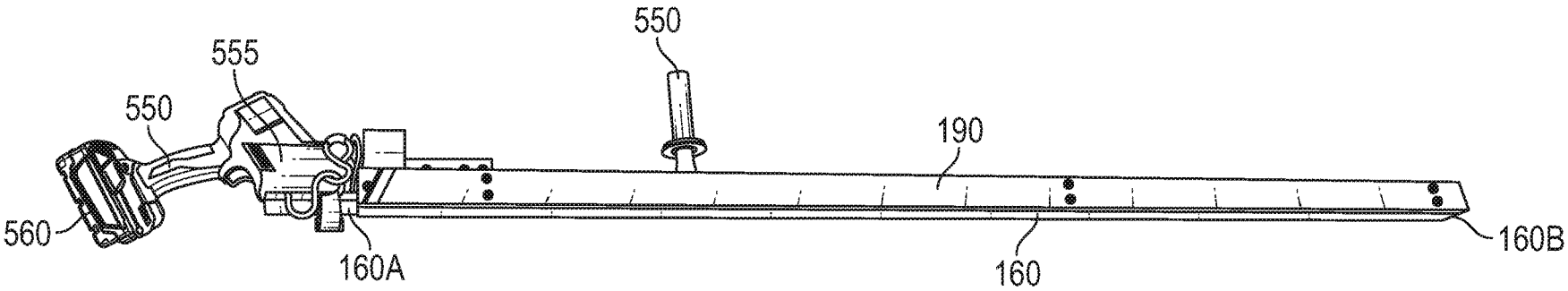
FIG. 26 shows another view of the handled embodiment of the screed shown in FIG. 25.

As shown in FIGS. 25-26, similar to the other disclosed embodiments, the screed 110 has a base bar 160 and screed bar 190 operationally connected to each other via outer and middle guides 260A1, 260A2, 260B between the first and second ends 160A, 160B of the base bar 160. At the first end 160A of the base bar 160, a reciprocating (or oscillating) power handle (or powered-grip) 550, similar to a power handle of a commercially available reciprocating saw or oscillating saw with an oscillating motor 555, is utilized. The reciprocating action may be produced in several ways. A crank or scotch-yoke type drive may be used, a swashplate type drive, a captive cam or eccentric, barrel cam, or other rotary to linear drive may be utilized. The power handle 550 may be battery powered by a removable and rechargeable battery 560.

Figure 27:
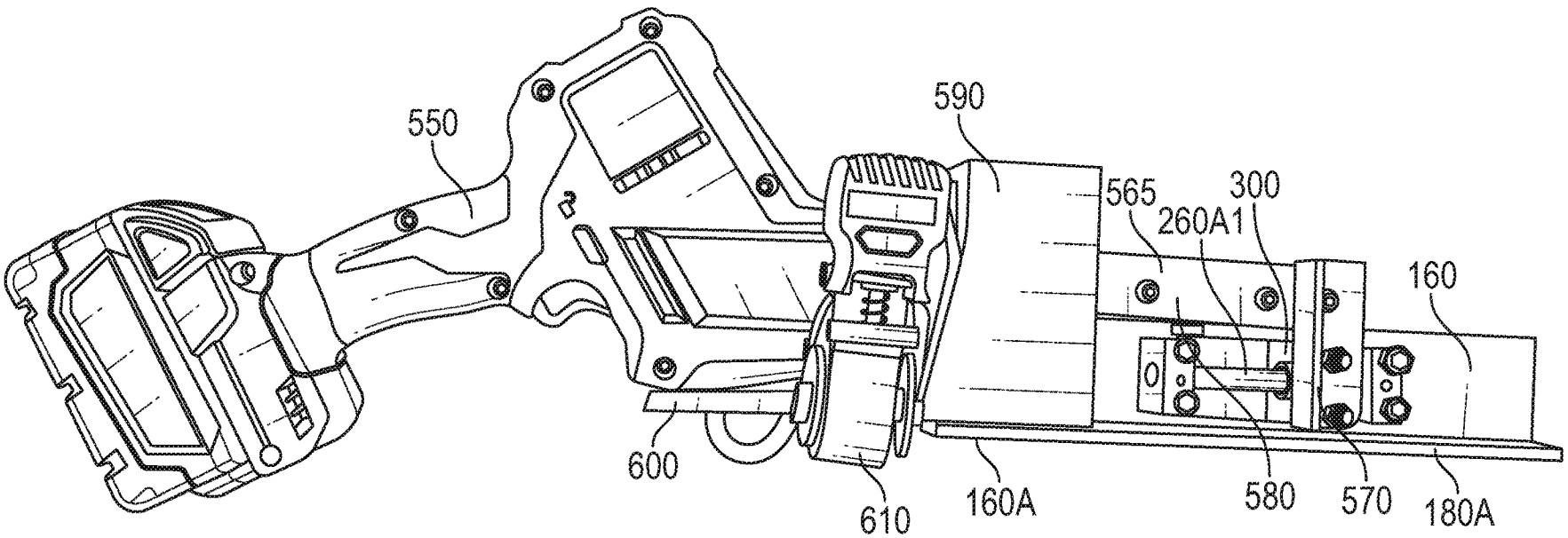
FIG. 27 shows the handle utilized in the screed of the embodiment shown in FIG. 25.

As shown in FIG. 27, the power handle 550 is operationally connected to the first slide bearing mount 300 of the first outer guide 260A1 at the first end 160A. That is, the first outer guide system 260A1 is a lead guide system and the middle guide system 260B and second outer guide system 260A2 are follower guide system.

A connector bracket 565 that connects the power handle 550 to the first slide bearing mount 300 is shown as an L-shaped bracket having a first member 570 that is connected to the first slide bearing mount 300 and a second member 580 that extends from the first member 570 to the power handle 550. The second member 580 has a clamp end 590 that is adapted to either fit within the chuck or blade clamp of the power handle 550 or grip a blade or other plate that is connected to the power handle 550. That is, the clamp end 590 is configured to be clamped and released from the power handle 550, similar to a reciprocating saw blade. For example, second member 580 of the connector bracket 565 may be formed of a pair of plates that are bolted together around a blade that is clamped to chuck of the power handle 550. Alternatively, the second member 580 of the connector bracket 565 may terminate at the clamp end 590 with a shape that is the same as the clamp end of a reciprocating saw blade to be directly clamped by the power handle 550.

Figure 29:
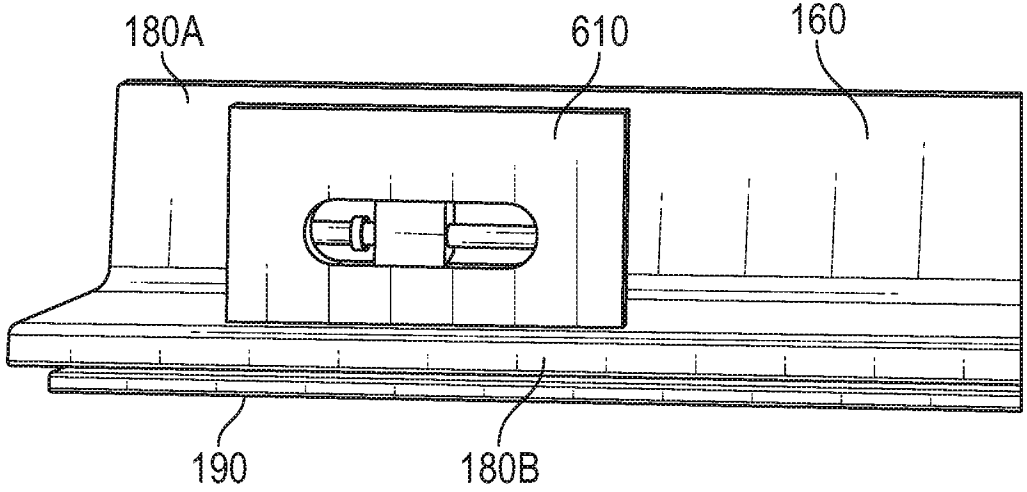
FIG. 29 is another view of the bearing cover utilized in the screed of the embodiment of FIG. 25.
Figure 28:
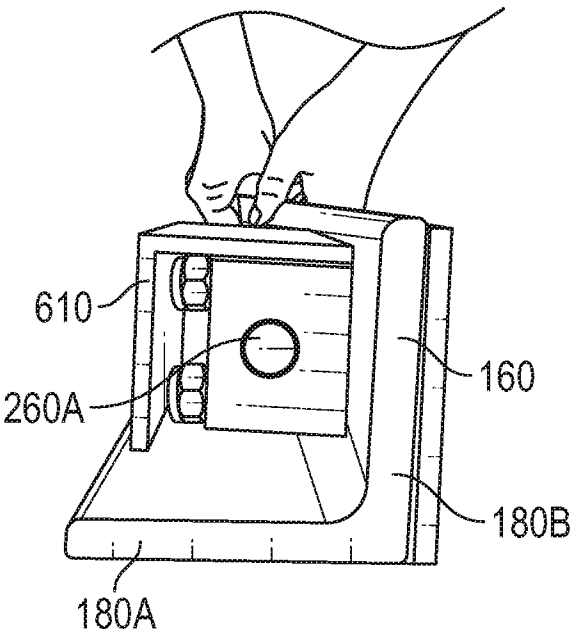
FIG. 28 shows a bearing cover utilized in the screed of the embodiment of FIG. 25.

A support plate 600 may extend from the first end 160A of the base bar 160, e.g., from the bottom member 180A to support the power handle 550. A strap 610, such as a nylon strap, may be utilized to fix the power handle 550 to the support plate 600. Turning to FIGS. 25, 28 and 29, outer and middle guide bearing covers 610, 620 may be utilized to cover the second outer guide system and middle guide system 260A2, 260B. The covers 610, 620 may be the same as each other and may be L-shaped and extend from the bottom member 180A to the upright member 180B of the base bar 160. The covers 610, 620 will protect the guide bearings from concrete and from damage during transport and use.

Figure 30:
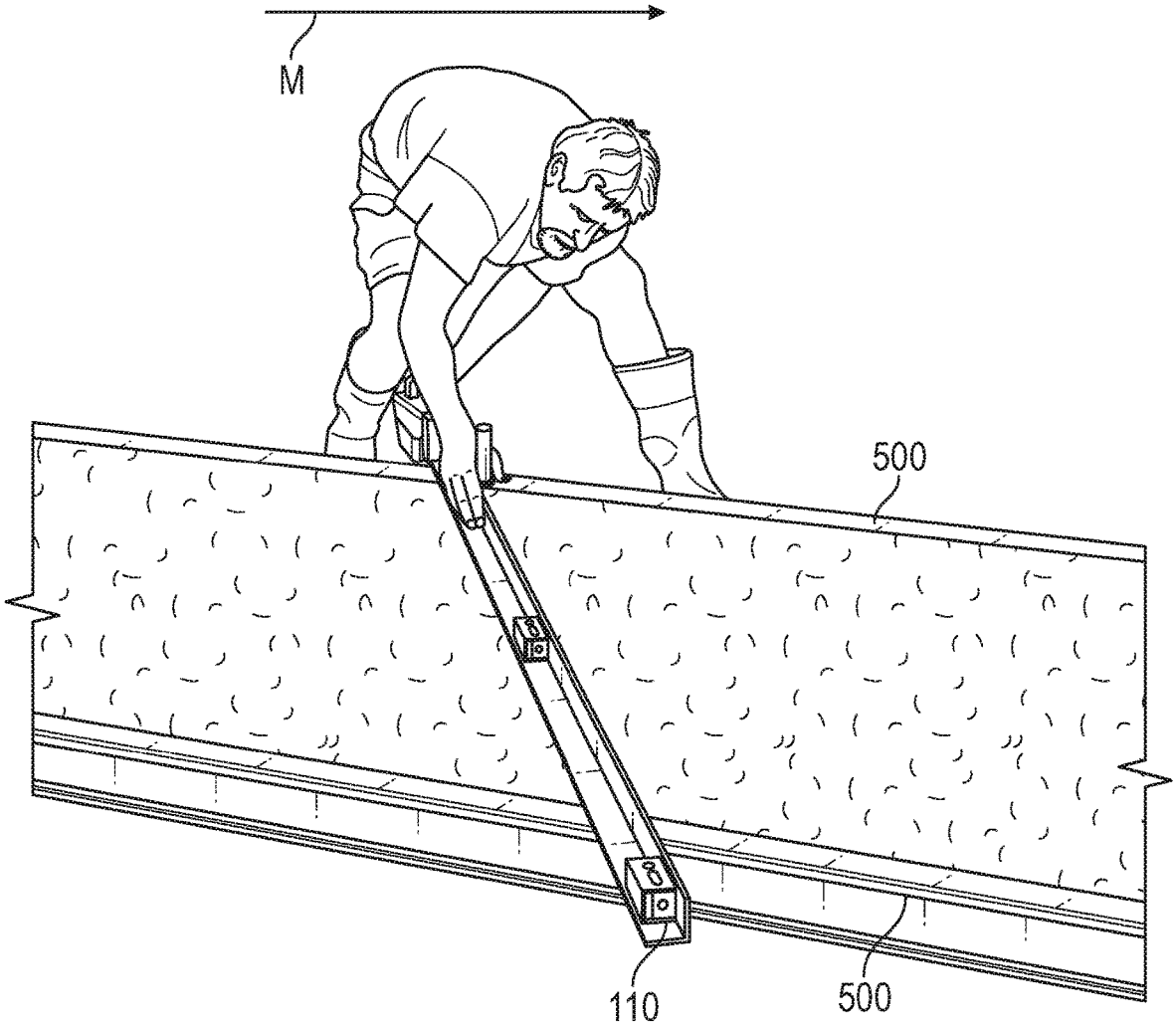
FIG. 30 shows the screed of FIG. 25 in operation.

FIG. 30 shows the handled screed 110 in operation, over parallel forms 500. The screed 110 is being moved in the direction of motion M over the forms.

The base bar 160 may be three inches tall and four inches deep for the embodiments in FIGS. 1-24 and two inches tall and deep for the embodiment shown in FIGS. 25-31.

Benefits of the disclosed embodiments may be assembled and disassembled with relative ease, for storage purposes and machine reconfiguration. The quick release electric motor allows the motor to be replaced rapidly if a problem should occur. Batteries quickly change also. With spare batteries, a standard charger, the embodiments will almost always be capable of running. The disclosed embodiments screeds, with a left to right motion (or vice versa), for an optimal concrete screed. The disclosed embodiments also eliminates the vibration issues associated with gas powered screeds. The disclosed embodiments, due to its weight and ease of use, provides an ability to perform sloped work, up, down, or across, without losing pitch. The disclosed embodiments is light enough to allow for multiple people to help pull the screed bar, should the need arise. For example, the back side of the bar or handle structure may be connected to a rake and pulled. The disclosed embodiments can wet float or rail ride with the same screed bar. The disclosed embodiments offers variable speeds and do not need to be turned off like a gas-powered screed. The disclosed embodiments can stop on a slab and then restart without lifting off and resetting like with a gas-powered screed. Weight can be added to the disclosed embodiments to weigh it down as may be needed. The disclosed embodiments are suitable for sidewalk applications and decorative concrete applications as well. The disclosed embodiments are quiet and do not produce dangerous fumes. With use of the disclosed embodiments, stone aggregate remains close to the surface where it is most beneficial for surface strength, and the embodiments do not leave a thick layer of fines at the surface. This is because the disclosed embodiments strike the surface of the wet concrete so as to remove the excess material off the top. The disclosed embodiments are light and versatile enough to ride over concrete slumps, work on wet, round and slopped slabs. Batteries and warn parts are replaceable via quick release connections. The interchangeability of the handles and the pivotal connections of the handles to the screed enable the screed to be configured for push or pull and for different use and comfort requirements.

As can be appreciated from the above discussion, the first, second and third directions are mutually perpendicular and are utilized for convenience. The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A concrete screed device, comprising:

a base bar extending between first and second ends and having a bottom member and an upright member;

a handle structure connected to the base bar, between the first and second ends, and extending away from the base bar to a grip portion;

a screed bar disposed against the upright member of the base bar;

guide members connected to the screed bar and extending through the upright member of the base bar;

a battery powered motor supported along the base bar and operationally connected to one of the guide members to oscillate the screed bar against the base bar; and a wheel supported under the bottom member of the base bar near the first end of the base bar.

2. The device of claim 1, wherein the handle structure is removably connected to the device and configured for being pivoted against the base bar.

3. The device of claim 1, wherein the handle structure is at least partially angled toward the wheel.

4. The device of claim 1, wherein:

the motor is supported within a motor housing that is removably connected to one of the guide members.

5. The device of claim 1, wherein the guide members include at least one guide member located midway between the first and second ends of the base bar, and the motor is removably connected to the at least one guide member.

6. The device of claim 1, wherein a motor control is secured to the grip portion of the handle structure.

7. The device of claim 6, wherein a first portion of a motor wire is connected to the motor control, a second portion of the motor wire is connected to the motor, and the first and second portions of the motor wires are connected to each other via a quick-release connector.

8. The device of claim 1, wherein a battery is removably connected to the motor.

9. The device of claim 1, wherein:

the base bar defines a base bar length;

the screed bar defines a screed bar length that is less than the base bar length; and the screed bar is configured such that it remains between the first and second ends of the base bar throughout the oscillatory range of movement.

10. The device of claim 1, further comprising a first wear strip disposed between the screed bar and the base bar.

11. The device of claim 10, wherein:

the upright member of the base bar includes a top channel and a bottom channel that are spaced apart from each other, wherein the first wear strip is disposed in the top channel and a second wear strip is disposed in the bottom channel.

12. The device of claim 11, wherein the top channel and the bottom channel have a trapezoidal shape.

13. The device of claim 1, wherein the screed bar defines a screed bar height;

the base bar defines a base bar height that is the same as the screed bar height; and the front surface of the screed bar, that faces away from the upright member of the base bar, is concave to define a shovel or plow.

14. A concrete screed device, comprising:

a base bar extending between first and second ends and having a bottom member and an upright member;

a screed bar disposed against the upright member of the base bar;

guide members connected to the screed bar and extending through the upright member of the base bar, including at least a guide member located near the first end of the base bar; and a battery powered hand-grip connected to the bottom member at the first end of the base bar, the hand-grip including an oscillating motor that is operationally connected to the guide member located near the first end of the base bar, wherein the oscillating motor oscillates the screed bar against the base bar.

15. The device of claim 14, wherein a battery is connected to the hand-grip via a quick release connection.

16. The device of claim 14, wherein:

the base bar defines a base bar length;

the screed bar defines a screed bar length that is less than the base bar length; and the screed bar is configured such that it remains between the first and second ends of the base bar throughout the oscillatory range of movement.

17. The device of claim 14, further comprising a first wear strip disposed between the screed bar and the base bar.

18. The device of claim 17, wherein:

the upright member of the base bar includes a top channel and a bottom channel that are spaced apart from each other, wherein the first wear strip is disposed in the top channel and a second wear strip is disposed in the bottom channel.

19. The device of claim 18, wherein the top channel and the bottom channel have a trapezoidal shape.

20. The device of claim 14, wherein:

the screed bar defines a screed bar height;

the base bar defines a base bar height that is the same as the screed bar height; and the front surface of the screed bar, that faces away from the upright member of the base bar, is concave to define a shovel or plow.

* * * * *